US011296409B1

(12) United States Patent
Yousefi et al.

(10) Patent No.: US 11,296,409 B1
(45) Date of Patent: Apr. 5, 2022

(54) EMBEDDED ANTENNA FOR CALIBRATION FOR A PHASED ARRAY ANTENNA

(71) Applicant: Amazon Technologies, Inc., Seattle, WA (US)

(72) Inventors: Tara Yousefi, Bellevue, WA (US); Alireza Mahanfar, Kirkland, WA (US); Murat Veysoglu, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 12 days.

(21) Appl. No.: 16/899,375

(22) Filed: Jun. 11, 2020

(51) Int. Cl.

| | |
|---|---|
| ***H01Q 3/30*** | (2006.01) |
| ***H01Q 1/48*** | (2006.01) |
| ***H01Q 13/10*** | (2006.01) |
| ***H01Q 9/04*** | (2006.01) |
| ***H01Q 1/36*** | (2006.01) |

(52) U.S. Cl.
CPC ..... *H01Q 3/30* (2013.01); *H01Q 1/36* (2013.01); *H01Q 1/48* (2013.01); *H01Q 9/0407* (2013.01); *H01Q 13/10* (2013.01)

(58) Field of Classification Search
CPC ..... H01Q 1/38–1/48; H01Q 3/30; H01Q 9/0407; H01Q 13/10; H01Q 1/288
See application file for complete search history.

(56) References Cited

U.S. PATENT DOCUMENTS

| | | | | |
|---|---|---|---|---|
| 6,847,328 | B1 * | 1/2005 | Libonati | H01Q 9/0407 343/700 MS |
| 2008/0094283 | A1 * | 4/2008 | Mei | H01Q 9/285 343/700 MS |
| 2019/0020100 | A1 * | 1/2019 | Jong | H01Q 1/523 |
| 2019/0027822 | A1 * | 1/2019 | Ayala Vazquez | H01Q 1/243 |
| 2021/0050649 | A1 * | 2/2021 | Hsu | H01Q 21/08 |

* cited by examiner

*Primary Examiner* — Hasan Islam
(74) *Attorney, Agent, or Firm* — Lowenstein Sandler LLP

(57) ABSTRACT

Technologies directed to embedding a calibration antenna in an antenna structure of a phased array antenna are described. The antenna structure includes a ground plane, a first antenna element, and a second antenna element. The first antenna element and the second antenna element are located in a first plane. The second antenna element is separated from the first antenna element by a first distance. Dielectric material is located between the ground plane and the first plane. The antenna structure further includes a third antenna element that is located in a second plane. The second plane is located between the ground plane and the first plane. The third antenna element is located in an area with a first dimension and a second dimension that are each less than half of the first distance.

19 Claims, 17 Drawing Sheets

700

EMBEDDED ANTENNA FOR CALIBRATION FOR A PHASED ARRAY ANTENNA

BACKGROUND

A large and growing population of users is enjoying entertainment through the consumption of digital media items, such as music, movies, images, electronic books, and so on. The users employ various electronic devices to consume such media items. Among these electronic devices (referred to herein as endpoint devices, user devices, clients, client devices, or user equipment) are electronic book readers, cellular telephones, Personal Digital Assistants (PDAs), portable media players, tablet computers, netbooks, laptops, and the like. These electronic devices wirelessly communicate with a communications infrastructure to enable the consumption of the digital media items. In order to communicate with other devices wirelessly, these electronic devices include one or more antennas.

BRIEF DESCRIPTION OF DRAWINGS

The present inventions will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
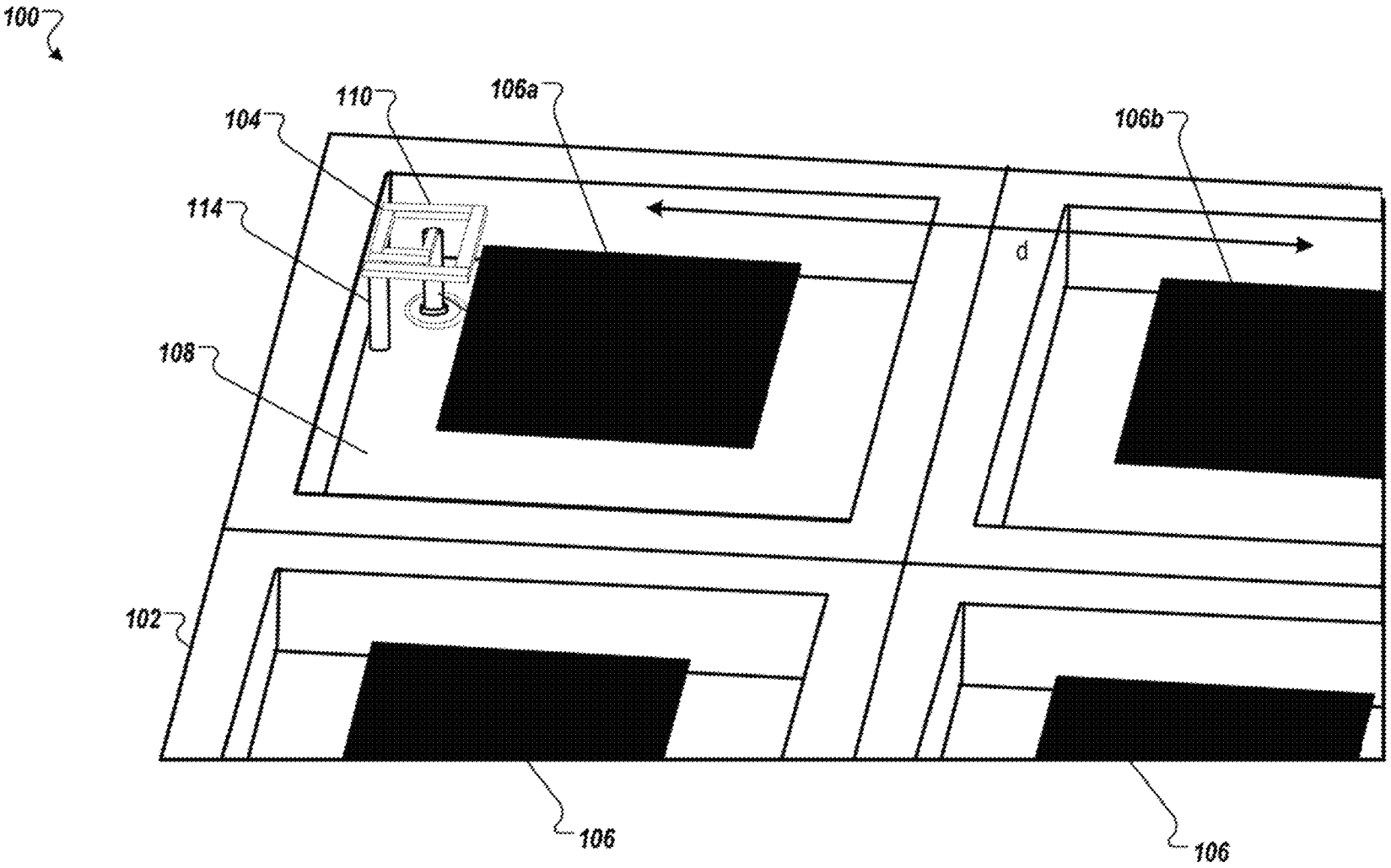
FIG. 1 illustrates an antenna structure with a phased array antenna and a calibration antenna on a support structure according to one embodiment.

Technologies directed to an embedded calibration antenna for a phased array antenna are described. Described herein are embedded calibration antenna designs for calibrating a phased array antenna. A conventional phased array antenna includes antenna elements. The conventional phased array antenna operates to form beams (e.g., of electromagnetic radiation) and steer the beams by relying on constructive and destructive interference of electromagnetic waves transmitted by each individual antenna element. An important part in the design and performance of a phased array antenna is the ability of calibrate the phased array antenna. There are a number of factors that can cause degradation of performance of active phased array antennas over time. In some cases, an active phased array antenna is airborne and/or satellite-borne can contain a large number of elements and a ground-based calibration may not be a practical means of calibration. In such cases a calibration antenna can be embedded within the phased array antenna and used for in-orbit calibration.

The calibration antenna can serve as an additional antenna within the phased array antenna to gather data from antenna elements of the phased array antenna. The data can be compared to initial data that was obtained and stored as reference data (also referred to as a golden reference) before the phased array antenna is launched and deployed in orbit. However, the choice of the type of antenna to use as the calibration antenna can present challenges due to a number of design constraints. One solution can be to use a monopole antenna which exhibits a desirable radiation pattern for calibration, however, due to size constraints, a monopole antenna may have relatively poor mechanical stability. As such a solution can be to use a calibration antenna that is fully embedded within the phased array antenna. In the embodiments described herein, a phased array antenna includes antenna elements that are located on a planar surface with dielectric material that fills the space between the planar surface and a ground plane of the phased array antenna, and fully embedded refers to the calibration antenna being fully encased by the dielectric material. In other words, the calibration antenna would be between the planar surface and the ground plane. One challenge with this solution is that the calibration antenna is required to be confined within a fixed volume, which depends on the frequency of operation of the calibration antenna. Another challenge is that the calibration antenna needs to have an appropriate length since it is intended to be fully embedded within the phased array antenna. Further the calibration antenna should exhibit an appropriate radiation pattern for calibration purposes. For example, for a phased array antenna that is intended to operate at 29 GHz, the maximum area available to the calibration antenna is approximately 0.9 mm×0.9 mm and the maximum height of the calibration is approximately 0.6 mm which is 0.06 of the operating wavelength in free space.

One potential solution involves using a helical antenna as the calibration antenna. A helical antenna can provide flexibility since it can operate in an axial mode or a normal mode. A helical antenna can operate in the axial mode when a circumference of the helix is on the order of one wavelength. An axial-mode helical antenna offers a number of interesting properties including a wide bandwidth and circularly polarized radiation. However, the height that would be required for an axial-mode helical antenna would be too high to allow for it to be fully embedded within the phased array antenna. Alternatively a helical antenna can operate in the normal mode when the circumference is much less than the wavelength. The radiation pattern of the normal-mode helical antenna can be desirable for calibration purposes, however, the height of the normal-mode helical antenna would still be too high to allow for it to be fully embedded within the phased array antenna.

Other potential solutions include spiral antenna in free space (e.g., a helical antenna mounted on a substrate and radiating in free space), which offers a radiation pattern and a return loss that can be used for calibration, but such an antenna would too large in area and in height to allow for it to be fully embedded within the phased array antenna. A patch antenna could have a sufficiently small height to be used, but would have an area that is too large. A monopole antenna could have a sufficiently small area to be used, but would have a height that is too large. In the example of a phased array antenna operating at 29 GHz, the area of the patch antenna would be 2.4 mm×2.4 mm while the height of the monopole antenna would be 2.5 mm.

Aspects of the present disclosure overcome the deficiencies of other calibration antennas by providing a hybrid design and utilizing ideas from helical antennas and patch antennas. Using the hybrid design allows the calibration antenna to have significant miniaturization in both area and height. The calibration antenna can have n calibration antenna element that can be flat like a patch antenna and include a spiral-like geometry to force surface currents to meander and therefore cause an artificial increase in the electric length (e.g., effective length) of the calibration antenna. A ground pin can cause an artificial decrease in the electrical length as needed. In the example of a phased array antenna operating at 29 GHz, the area of the calibration antenna with the hybrid design can be 0.8 mm×0.9 mm which is one twelfth of the wavelength ($\lambda_g/12$) and the height of can be 0.6 mm. The calibration antenna with the hybrid design can be fully embedded within the dielectric material of the phased array antenna and can still offer good antenna performance, such as radiation pattern and return loss.

FIG. 1 illustrates an antenna structure 100 with a phased array antenna 102 and a calibration antenna 104 on a support structure according to one embodiment. The phased array antenna 102 includes a set of antenna elements 106 disposed on the support structure. The set of antenna elements 106 is organized as a grid. The grid has an inter-element spacing of a first distance (d) between each of the set of antenna elements 106. That is, an inter-element spacing value is equal to the first distance. Each of the set of antenna elements 106 is separated from each adjacent antenna element 106 by a wall or a wall structure. The phased array antenna 102 can be coupled to first radio frequency front-end (RFFE) circuitry that is coupled to a first RF module circuit that operates at a frequency within a bandwidth. The first RFFE circuitry is coupled to the set of antenna elements 106. The first RF module circuit can include a baseband processor. The support structure can be a circuit board, such as a printed circuit board (PCB), or other structure upon which the antenna elements can be positioned. The phased array antenna 102 includes a ground plane 108. Dielectric material is located on a first side of the ground plane 108, and in particular, between the ground plane 108 and first plane of the antenna elements 106. The antenna elements 106 are located on the dielectric material in a first plane, and two adjacent antenna elements, such as an antenna element 106*a* and an antenna element 106*b* of an antenna array, are separated by at least the first distance (d). The phased array antenna 102 also includes a calibration antenna 104 which is coupled to second RFFE circuitry that is coupled to a second RF module circuit that operates at the frequency within the bandwidth. The calibration antenna 104 is fully embedded within the dielectric material of the phased array antenna 102. The calibration antenna 104 includes a calibration antenna element 110, a ground pin 114, and a feed point 116 that are also fully embedded within the dielectric material. The calibration antenna element 110 is located on a second plane that is parallel to and between the first plane and the ground plane 108. The antenna elements 106, including the antenna elements 106*a* and 106*b*, being part of the phased array antenna 102 coupled to the first RFFE circuitry are configured for operating as part of the phased array antenna 102, while the calibration antenna 104, being coupled to the second RFFE circuitry is configured to operate as a calibration antenna for in-orbit calibration of the phased array antenna 102 when it is in orbit. The dielectric material can be characterized by a permittivity, such as a relative permittivity ($\varepsilon_r$) or a dielectric constant. In one embodiment, the relative permittivity of the dielectric material is 3.56. In other embodiments, the dielectric material can be any other suitable dielectric material with a different relative permittivity.

Although the antenna elements 106 are represented in the figures as square elements any size or type of antenna can be located at the corresponding square element. In some cases, the antenna elements are square-shape patch antenna elements. In other embodiments, the antenna elements can be other shapes, such as rectangular, circular, or other suitable shape. In another embodiment, the antenna elements are slots in material as slot elements (slot antennas). Alternatively, the elements can be other types of antenna element types, such as microstrip antennas, planar inverted-F antennas (PIFAs), or the like, that are used in phased array antennas. Alternatively, the elements are not necessarily part of a phased array antenna, but a group of elements that can be used for other wireless communications than beam steering.

Figure 2:
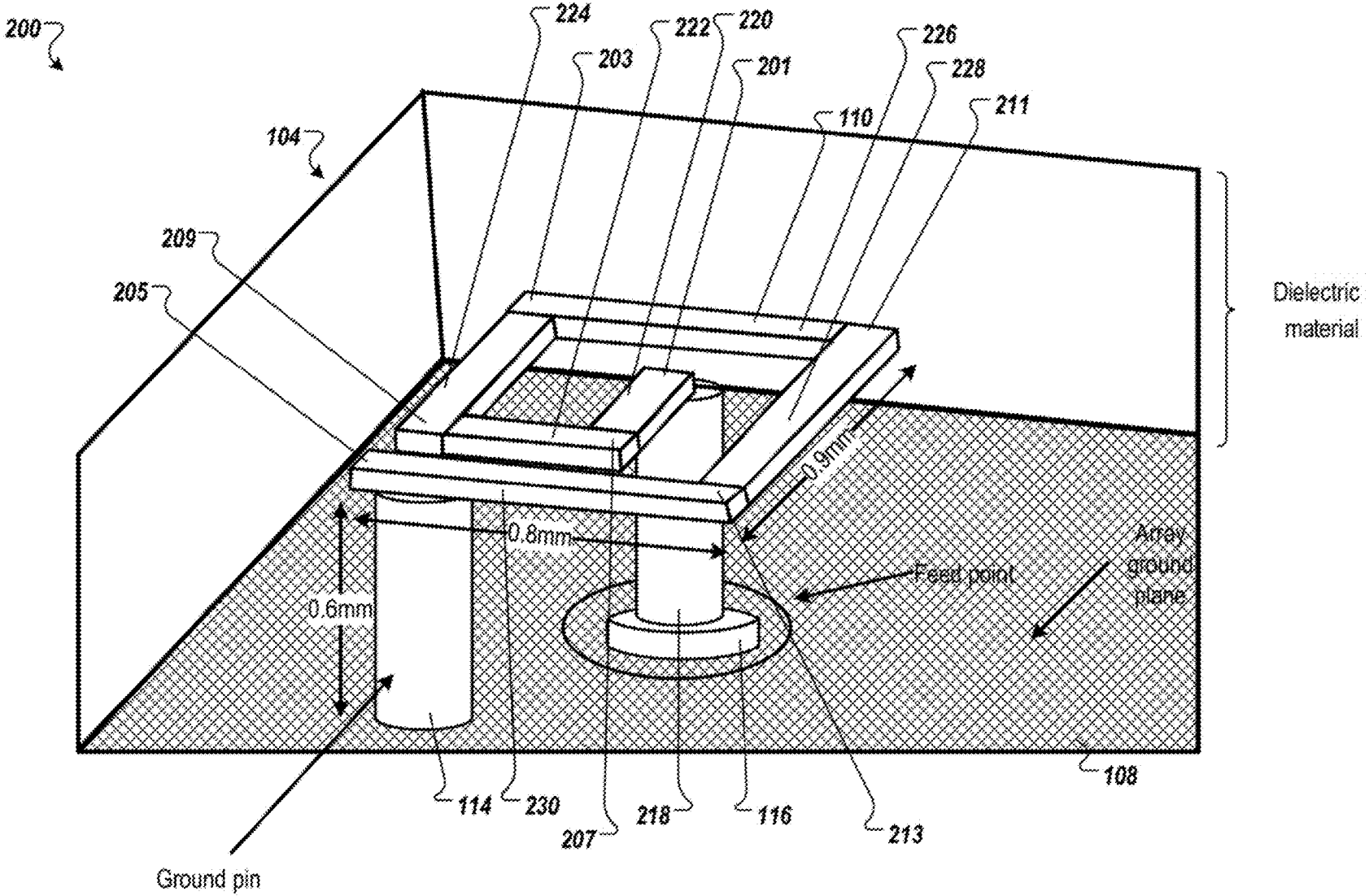
FIG. 2 illustrates an antenna structure with the calibration antenna according to one embodiment.

FIG. 2 illustrates an antenna structure 200 with the calibration antenna 104 according to one embodiment. Although not all components of the antenna structure 200 are shown, the antenna structure 200 is the same or similar to the antenna structure 100 of FIG. 1 as noted by similar reference numbers. The calibration antenna element 110 is located in an area of the dielectric material and is fully embedded within the dielectric material. The calibration antenna element 110 includes a calibration antenna element 110, a ground pin 114, and a feed point 116. The calibration antenna 104 further includes a conductor 218 (e.g., a first conductor) that is coupled between a first end of the calibration antenna element 110 and the feed point 116. The feed point 116 is located in an opening of the ground plane 108. The ground pin 114 (e.g., second conductor) is coupled between a second end of the calibration antenna element 110 and the ground plane 108. Alternatively, the ground pin 114 can be coupled between calibration antenna element 110 and the ground plane at a different position on the calibration element 110, such as at a second distance from the second end. By moving the ground pin 114 away from the second end, an effective length of the calibration antenna element 110 can be reduced.

The calibration antenna element 110 includes a conductive trace. A distance along the conductive trace from the location of the conductor 218 to the location of the ground pin 114 corresponds to an electrical length or an effective length of the calibration antenna element 110. The effective length of the calibration antenna element 110 is related to a wavelength or operating frequency of the phased array antenna 102. The conductive trace traverses from a point 201 within the area to a point 203 located around the perimeter of the area to a point 205 on the perimeter of the area. In other words the conductive trace traverses from the point 203 around the perimeter of the area to the point 205 on the perimeter of the area such that the conductive trace surrounds the point 201 at least once. The point 201 is located at the first end of the calibration antenna element 110 and the third point 205 is located at the second end of the calibration antenna element 110. In other embodiments, for example, when a shorter effective length of the calibration antenna element 110 is desired, the conductive trace can surround the point 210 less than once, for example it can surround the first point by 50%, 75%, or other fraction.

In another embodiment, the calibration antenna element 110 includes seven segments. A first segment 220 is located between the point 201 and a point 207 within the area. A second segment 222 is located between the point 207 and a point 209 that is located on the perimeter of the area. The second segment 222 is perpendicular (e.g., orthogonal) to the first segment 220 and is longer than the first segment 220. A third segment 224 is located between the point 209 and the point 203 that is located on the perimeter of the area. The third segment 224 is perpendicular to the second segment 222 and parallel to the first segment 220. The third segment 224 is longer than the second segment 222. A fourth segment 226 is located between the point 203 and a point 211 that is located on the perimeter of the area. The fourth segment 226 is perpendicular to the third segment 224 and the first segment 220 and parallel to the second segment 222. The fourth segment 226 is longer than the third segment 224. A fifth segment 228 is located between the point 211 and a point 213 that is located on the perimeter of the area. The fifth segment 228 is perpendicular to the fourth segment 226 and the second segment 222 and is parallel to the third segment 224 and the first segment 220. The fifth segment 228 is longer than the fourth segment 226. A sixth segment 230 is located between the point 213 and the point 205 that is located on the perimeter of the area. The sixth segment 230 is perpendicular to fifth segment 228, the third segment 224, and the first segment 220 and is parallel to the fourth segment 226 and the second segment 222. The sixth segment 230 is longer than the fifth segment 228. Each of the segments 220-230 are oriented to create a winding pattern (e.g., a spiral pattern) in the second plane that can be characterized by one of two chiralities (e.g., handedness) that are mirror images of the other. In the illustrated embodiment of FIG. 2, the segments 220-230 of the conductive trace form a rectangular spiral pattern. The segments 220-230 can be a single integrated conductive trace, they can be separate pieces of conductive trace that are connected, or a combination thereof. The conductor 218 is connected between the point 201 and the feed point 116. In one embodiment, the ground pin is coupled between the point 205 and the ground plane 108. In another embodiment, the ground pin can be coupled to the ground plane 108 and the sixth segment 230 at a position along the sixth segment 230 that is between the point 205 and the point 213 to change the effective length of the calibration antenna element 110. It should be noted that the number of windings and the spacing of the windings can be constrained by manufacturing limitations. For example, the thickness of the traces and the constrained areas can define the spacing between the winding.

Although depicted as a rectangular spiral pattern, in other embodiments the conductive trace of the calibration antenna element 110 can be formed into other winding patterns, such as a circular spiral, an elliptical spiral, a square spiral, a back-and-forth winding pattern, or the like.

Figure 3:
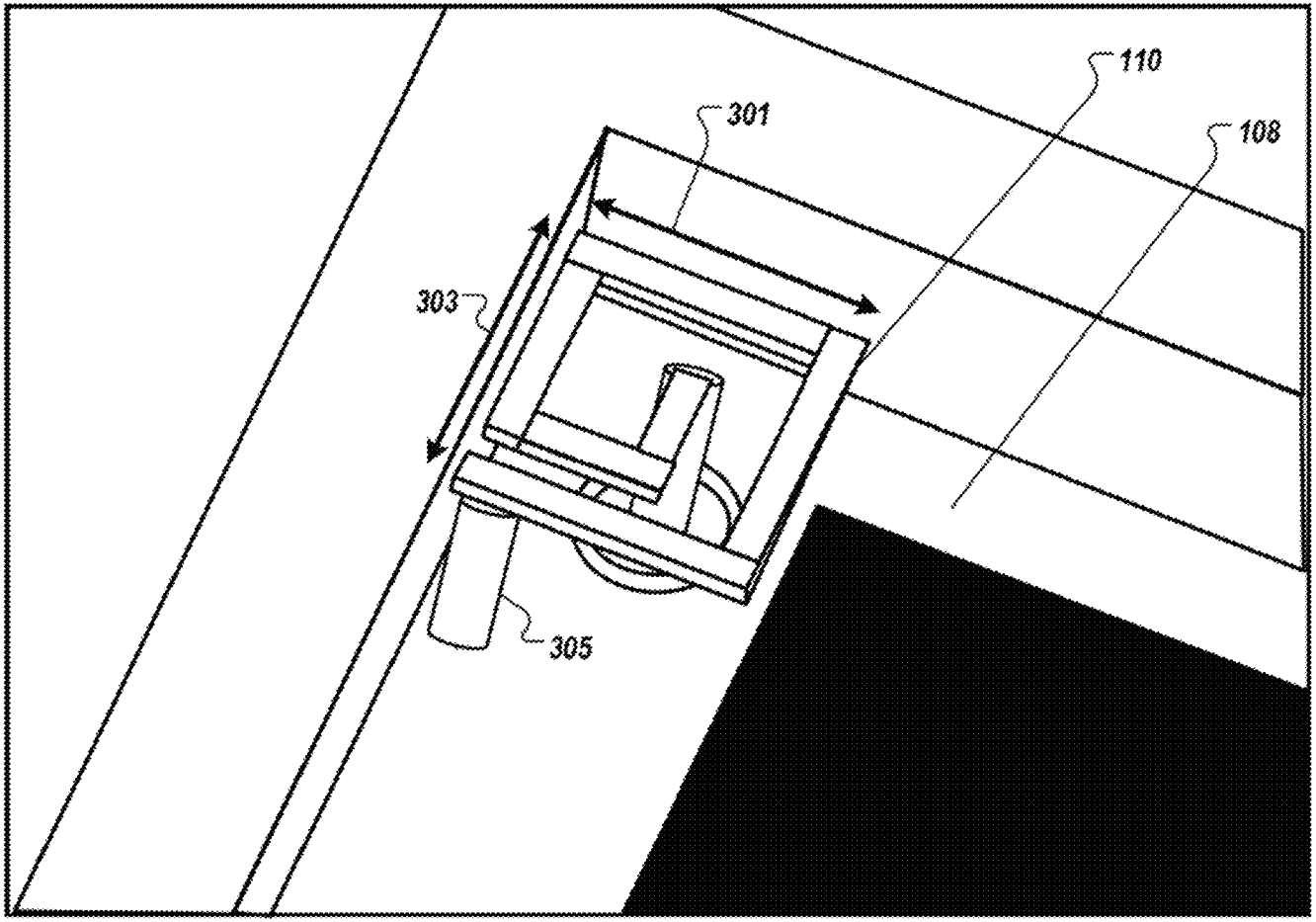
FIG. 3 illustrates an antenna structure with the calibration antenna according to one embodiment.

FIG. 3 illustrates an antenna structure 300 with the calibration antenna 104 according to one embodiment. Although not all components of the antenna structure 300 are shown, the antenna structure 300 is the same or similar to the antenna structure 100 of FIG. 1 as noted by similar reference numbers. The calibration antenna element 110 is located in an area of the dielectric material and is fully embedded within the dielectric material.

The perimeter of the area can be characterized by a first dimension 301 and a second dimension 303 that are measured in a plane that is parallel to the first plane, the second plane, and the ground plane 108. In the case where the conductive trace forms a rectangular spiral pattern, for example as depicted in FIG. 2, the value of the area can be defined by the first dimension 301 multiplied by the second dimension 303. In order for the calibration antenna 104 to not overlap the any antenna element 106, the first dimension 301 and the second dimension 303 are each less than half of the first distance that separates adjacent antenna elements 106. In one embodiment, the first dimension and the second dimension are perpendicular and can be thought of as a length (not to be confused with the effective length of the antenna element) and width of an area occupied by the antenna element.

Since the calibration antenna 104 should be fully embedded within the dielectric material located between the first plane and the ground plane, a height of the calibration antenna 104 measured along a direction that is perpendicular to the first plane and the ground plane 108 should be less than the distance 305 between the first plane and the ground plane 108. Therefore, the calibration antenna 104 can be contained in a volume defined by the first dimension 301, the second dimension 303, and the distance 305 between the first plane and the ground plane 108.

Although depicted in the figures as having a single calibration antenna 104, some phased array antennas can have more than one calibration antenna. For example, the set of antenna elements 106 can include a third antenna element and a fourth antenna element, and the phased array antenna can include a second calibration antenna which is coupled to third RFFE circuitry that is coupled to a third RF module circuit. The third antenna element and the fourth antenna element can be located in the first plane, and the third antenna can be separated from the fourth antenna element by the first distance. The second calibration antenna includes a second calibration antenna element that is located on a fourth plane that is parallel to and between the first plane and the ground plane. The second calibration antenna element is located in a second area of the dielectric material. The second area has a third dimension and a fourth dimension. The second area can be located between the third antenna element and the fourth antenna element. Additionally or alternatively, the third antenna element can be located at the edge the antenna array of the phased array antenna and the second area can be located between the third antenna element and the edge of the antenna array. In one case, the second calibration antenna is identical to the calibration antenna 104, and then the fourth plane is the same as the second plane, the third dimension can be the same as the first dimension, and the fourth dimension can be the same as the second dimension. In other cases, there can be more than two calibration antennas, such as three, four, or more, that can be embedded regularly, periodically, randomly, or the like within the antenna array.

Figure 4A:
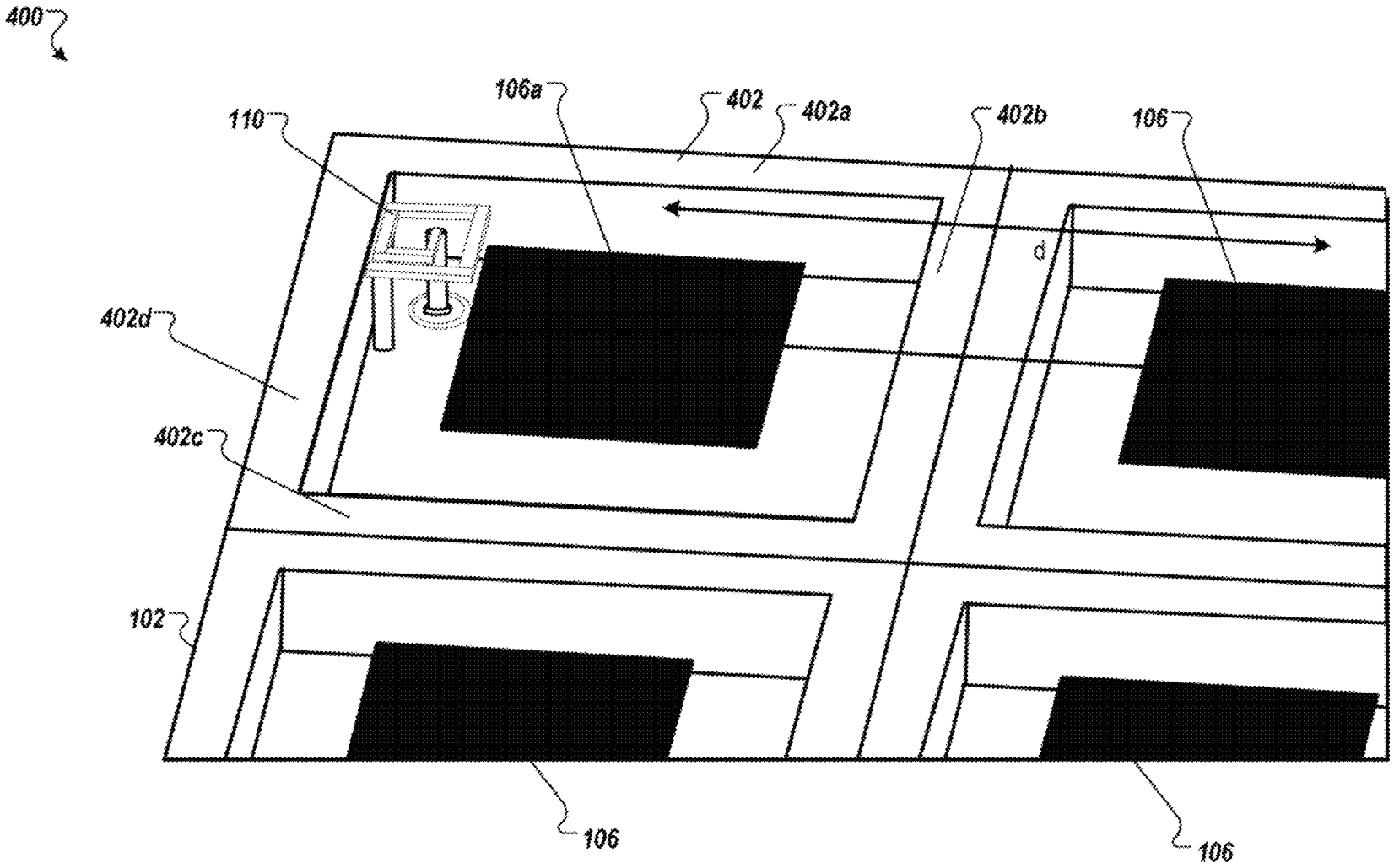
FIG. 4A illustrates an antenna structure with the calibration antenna according to one embodiment.

FIG. 4A illustrates an antenna structure 400*a* with the calibration antenna 104 according to one embodiment. Although not all components of the antenna structure 400*a* are shown, the antenna structure 400*a* is similar to the antenna structure 100 of FIG. 1 as noted by similar reference numbers. The calibration antenna element 110 is located in an area of the dielectric material and is fully embedded within the dielectric material. The antenna structure 400 can include a wall structure 402 that forms a second perimeter around the antenna element 106*a*. The wall structure 410 includes four walls: a wall 402*a*, a wall 402*b*, a wall 402*c*, and a wall 402*d*. The wall 402*a* and the wall 402*c* are mutually parallel and are both perpendicular to the wall 402*b* and the wall 402*d*. An antenna element 106 that is located at a corner of the antenna structure 400*a* is adjacent to two other antenna elements 106 and has two walls that are edges and two walls that are shared (e.g., with the two other adjacent antenna elements 106). An antenna element 106 that is located on an edge but not a corner of the antenna structure 400*a* is adjacent to three other antenna elements 106 and has one wall that is an edge and three walls that are shared (e.g., with the three other adjacent antenna elements 106). An antenna element 106 that is located in a central area of the phased array antenna 400*a* has no edges and four walls that are shared (e.g., with the fourth other adjacent antenna elements 106). In one embodiment, the wall structure 402 can be a conductive material located on the first plane. In other embodiments, the wall structure 402 can be a conductive material with one end of the wall structure at the first plane and another end of the wall structure at the ground plane 108 (e.g., a top of the wall structure 402 could be in the first plane and a bottom of the wall structure 402 could be in the ground plane or alternatively, the bottom of the wall structure 402 could be in the first plane and the top of the wall structure 402 could be in the ground plane).

In the depicted embodiment, the calibration antenna element 110 is located in a corner of the antenna structure 400. The calibration antenna element 110 is located in a portion of the area that is between the antenna element 106*a* and the wall 402*d*. The calibration antenna element 110 can further be located in a portion of the area that is between the antenna element 106*a* and the wall 402*d*. In general, the calibration antenna element 110 can be located between an antenna element 106 and at least one wall (e.g., side) of the wall structure 402. The calibration antenna 110 can be located between an antenna element 106 and the at least one wall for an antenna element that is located at a corner of the antenna structure, at an edge of the antenna structure, or within a central portion of the antenna structure.

Although depicted in FIG. 4A as having a single calibration antenna 104, some phased array antennas can have more than one calibration antenna. For example, the set of antenna elements 106 can include a third antenna element, and the phased array antenna can include a second calibration antenna which is coupled to third RFFE circuitry that is coupled to a third RF module circuit. The third antenna element can be located in the first plane. The second calibration antenna includes a second calibration antenna element that is located on a fourth plane that is parallel to and between the first plane and the ground plane. The second calibration antenna element is located in a second area of the dielectric material. The second area has a third dimension and a fourth dimension. The third antenna element can be located at the edge of the phased array antenna and the second area can be located between the third antenna element and the edge of the antenna array. In one case, the second calibration antenna is identical to the calibration antenna 104, and then the fourth plane is the same as the second plane, the third dimension can be the same as the first dimension, and the fourth dimension can be the same as the second dimension.

Figure 4B:
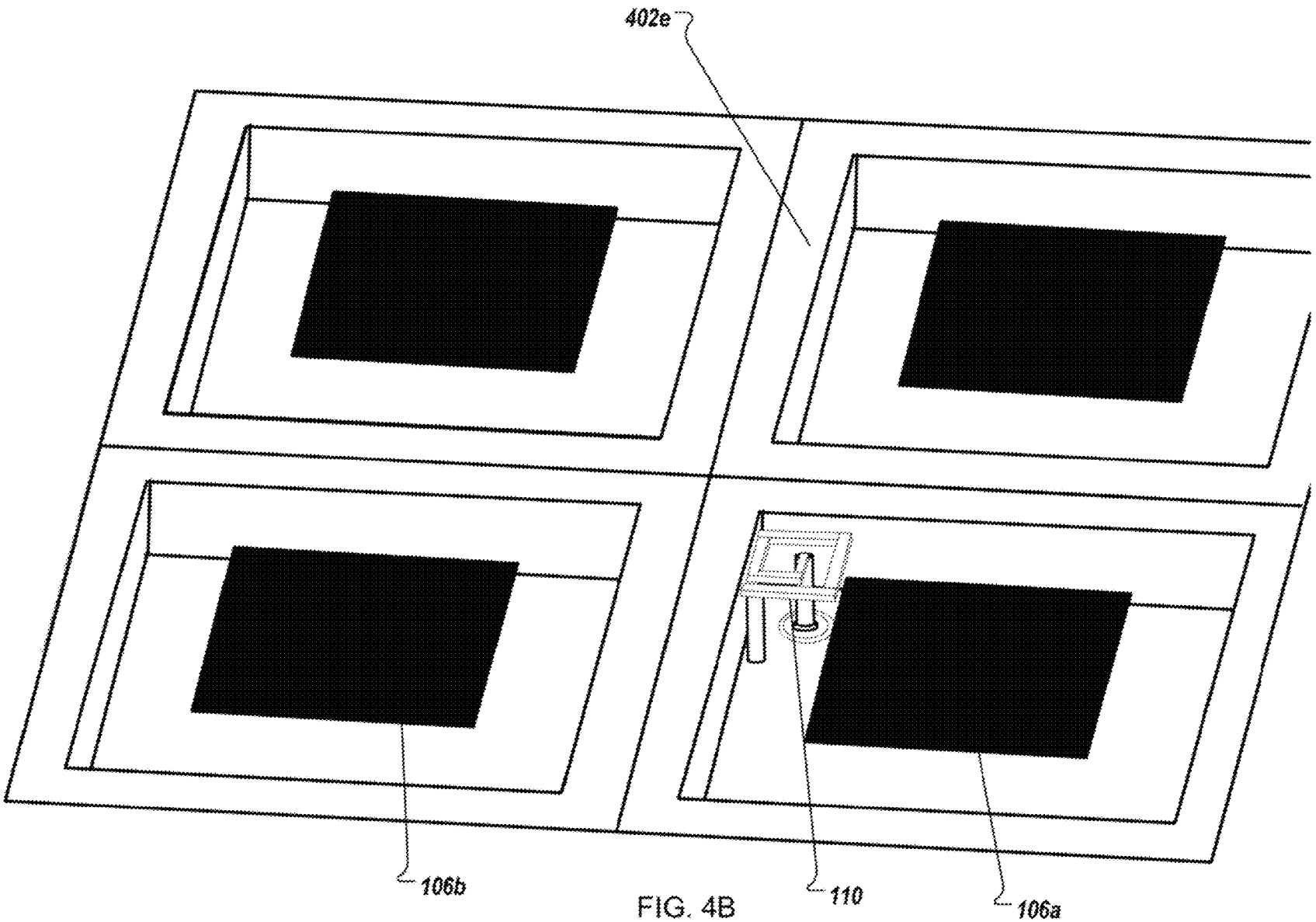
FIG. 4B illustrates an antenna structure with the calibration antenna according to another embodiment.

FIG. 4B illustrates an antenna structure 400*b* with the calibration antenna 104 according to another embodiment. Although not all components of the antenna structure 400*b* are shown, the antenna structure 400*a* is similar to the antenna structure 100 of FIG. 1 as noted by similar reference numbers. The calibration antenna element 110 is located in an area of the dielectric material and is fully embedded within the dielectric material. The antenna structure 400*b* includes a wall 402*e* that separates an opening in which the antenna element 106*a* is located and an opening in which the antenna element 106*b* is located. The calibration antenna element 110 is located between the antenna element 106*a* and the wall 402*e*. This can occur any time the calibration antenna element 110 is located between an antenna element 106 and a shared wall. In other words, a first wall separates a first opening in which a first antenna element is located and a second opening in which a second antenna element is located. The calibration antenna element 110 is located in a portion of the area that is located between the first antenna element and the first wall.

Figure 5:
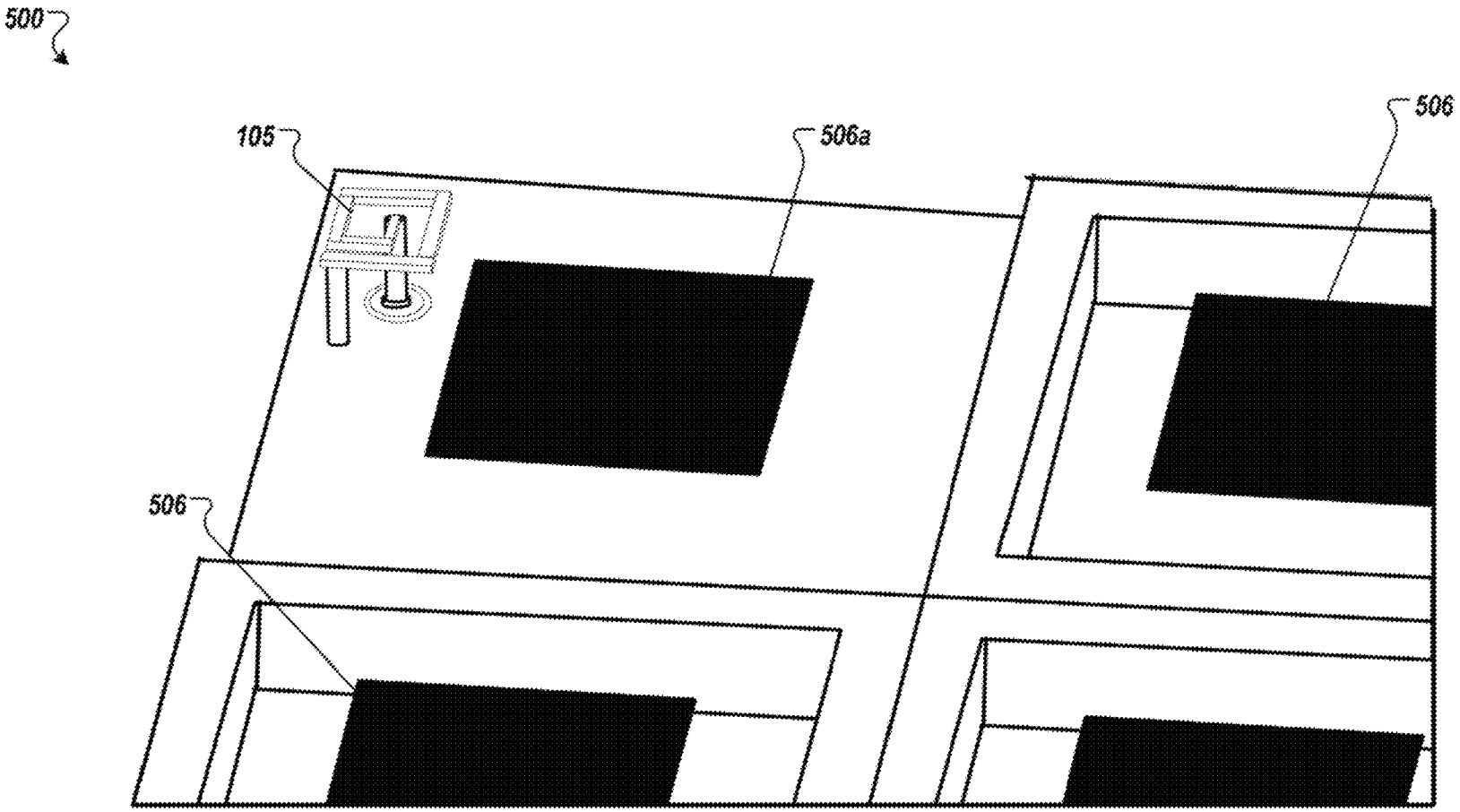
FIG. 5 illustrates an antenna structure with a phased array antenna and the calibration antenna according to another embodiment.

FIG. 5 illustrates an antenna structure 500 with a phased array antenna 502 and the calibration antenna 104 according to another embodiment. The antenna structure 500 is similar to the antenna structure 100 of FIG. 1, except as noted below. The phased array antenna 502 includes a set of antenna elements 506 disposed on the support structure and organized as the grid, except that one or more of the antenna elements 506 are not separated from adjacent antenna elements by a wall or a wall structure. The antenna elements 506 are located on a first plane and the dielectric material is located between the ground plane and the first plane. In the depicted embodiment, the calibration antenna 104 can be located between an antenna element 506*a* and an edge of the antenna structure 500. In another embodiment, the calibration antenna can be located between a first antenna element 506*a* and a second antenna element 506 (not shown in FIG. 5).

Figure 6:
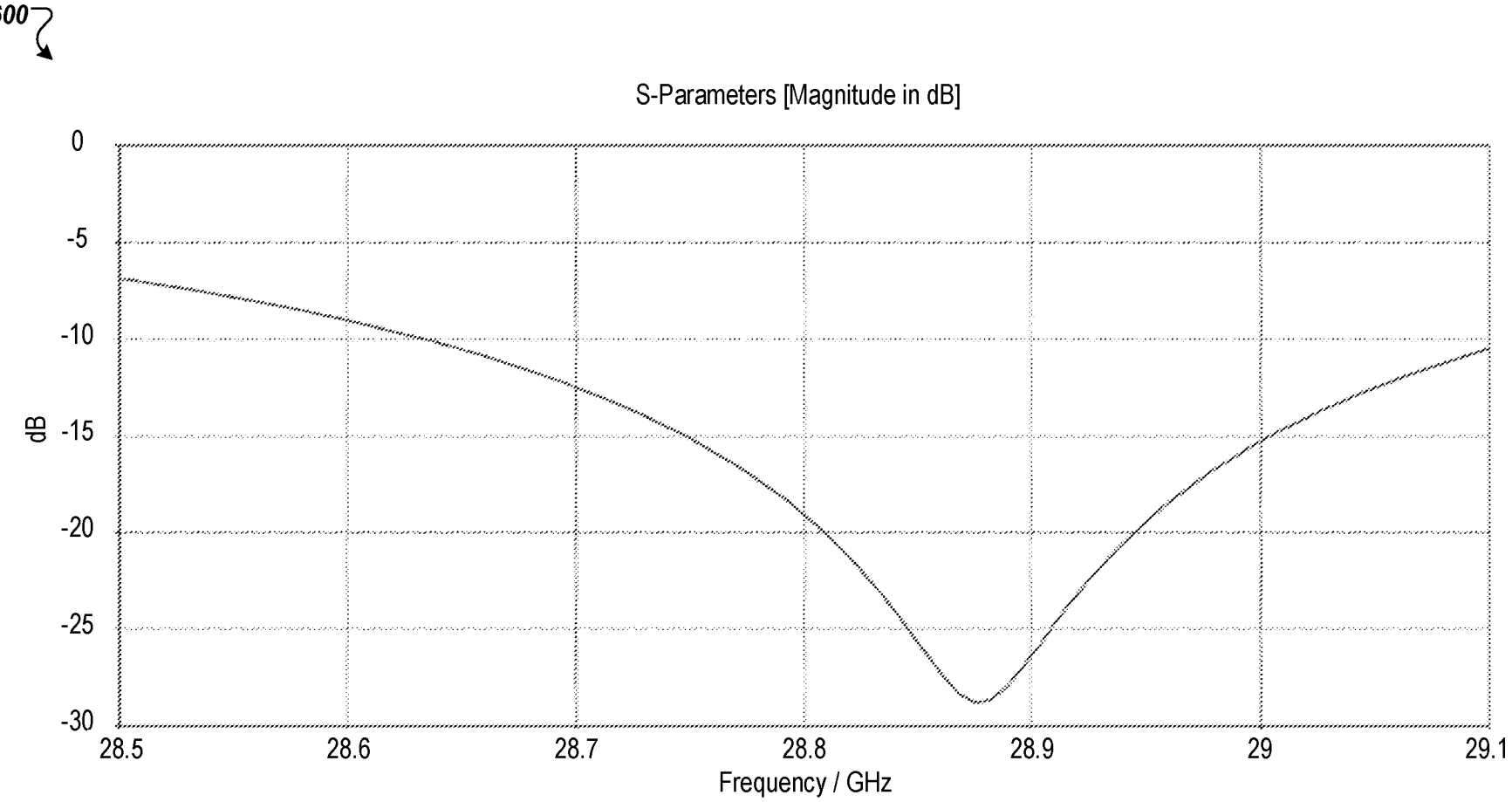
FIG. 6 is a graph of a return loss of a calibration antenna as a function of frequency according to one embodiment.

FIG. 6 is a graph 600 of a return loss of a calibration antenna as a function of frequency in free space according to one embodiment. The calibration antenna can be the same or similar to the calibration antenna 104 of FIGS. 1-2. A resonant frequency of the calibration antenna occurs between 28.85 GHz and 29.90 GHz in the graph 600. It should be noted however, that the resonant frequency of a calibration can be tuned, for example by varying an effective length, a shape and/or winding pattern, a position of the ground pin, or other factors.

Figure 7:
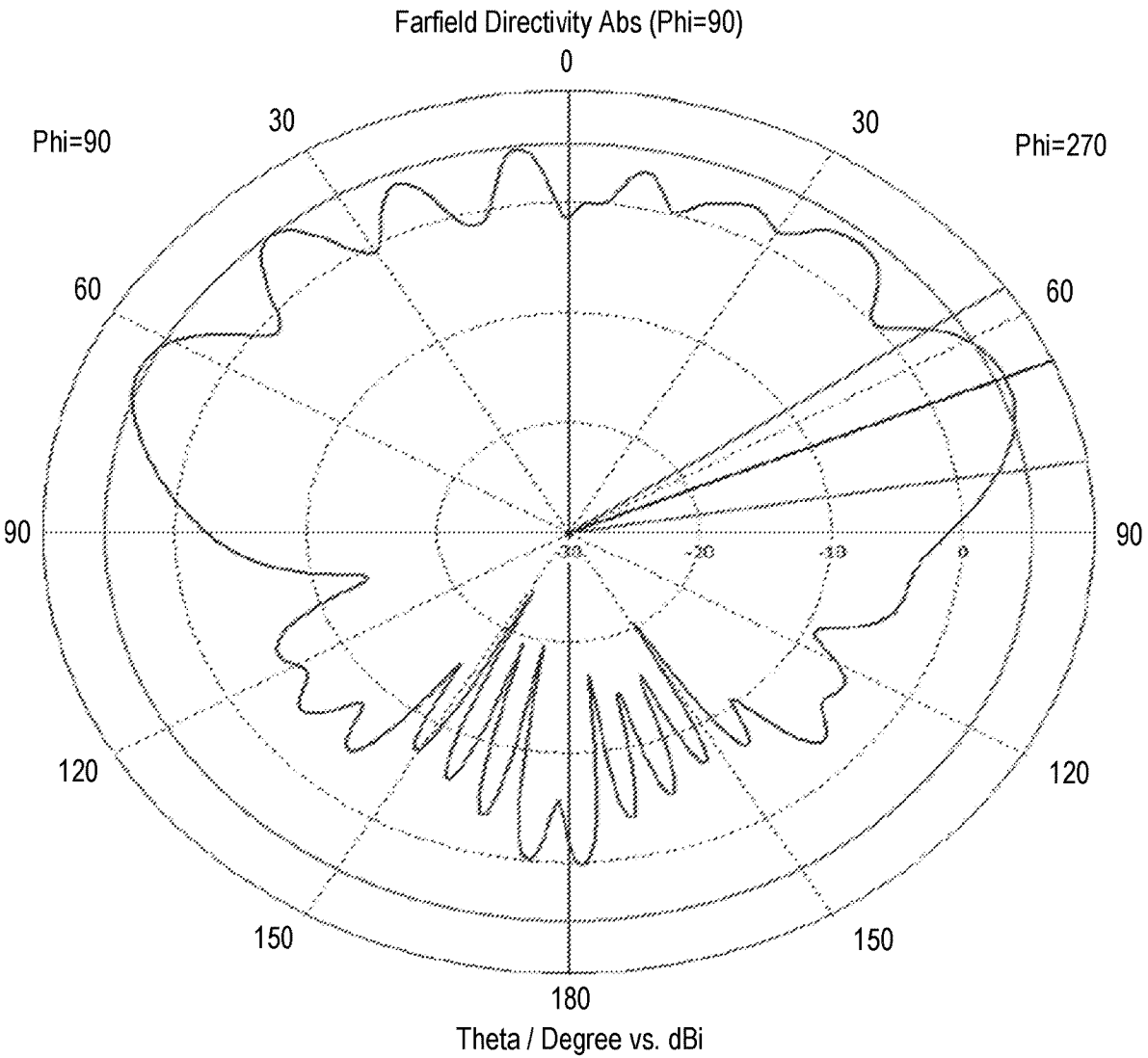
FIG. 7 is a graph of a two-dimensional (2D) radiation pattern of a calibration antenna according to one embodiment.

FIG. 7 is a graph 700 of a two-dimensional (2D) radiation pattern of a calibration antenna according to one embodiment. The calibration antenna can be the same or similar to the calibration antenna 104 of FIGS. 1-2. An equatorial line (e.g., along Theta=90 degrees) represents the ground plane. The radiation pattern below the ground plane (e.g., from Theta=90 degrees to 180 degrees) does not affect in-orbit calibration of antenna elements.

Figure 8:
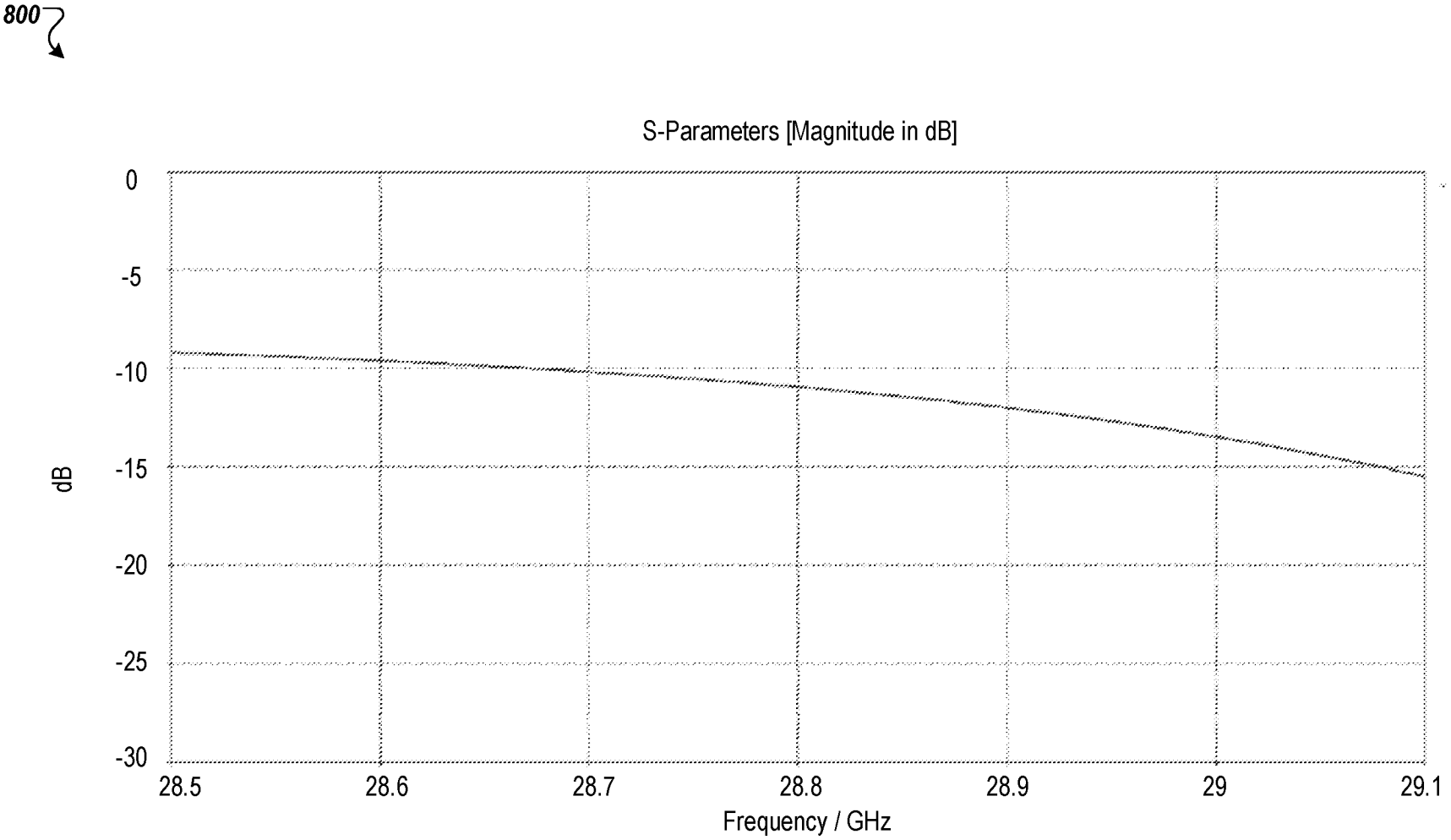
FIG. 8 is a graph of a return loss of a calibration antenna embedded in a phased array antenna as a function of frequency according to one embodiment.

FIG. 8 is a graph 800 of a return loss of a calibration antenna embedded in a phased array antenna as a function of frequency according to one embodiment. The calibration antenna can be the same or similar to the calibration antenna 104 of FIGS. 1-2.

Figure 9A:
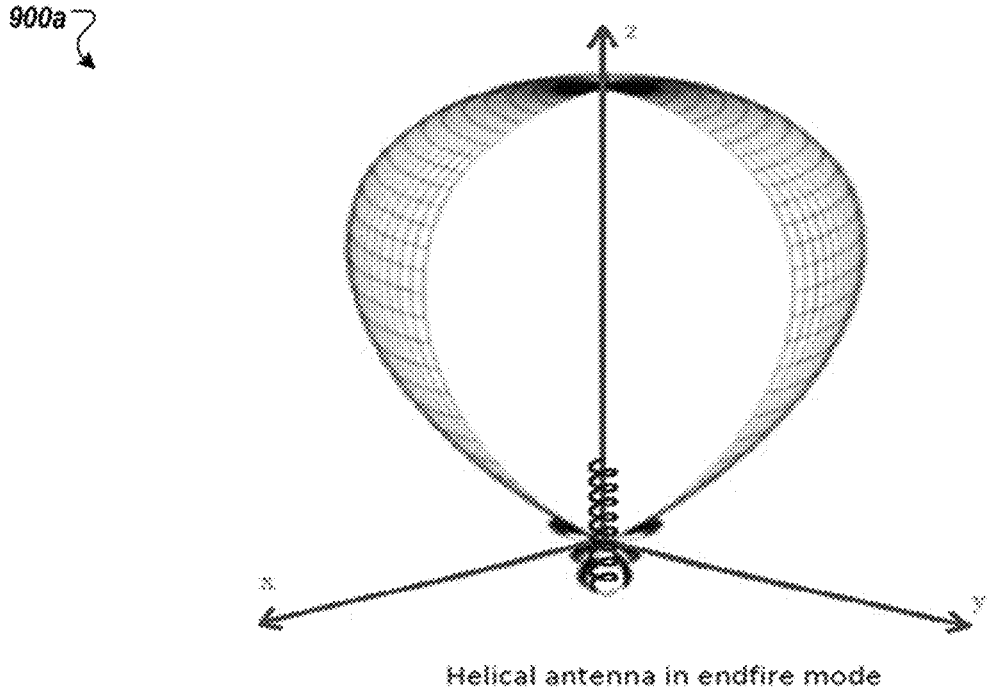
FIG. 9A is a graph illustrating a radiation pattern of a helical antenna operating in an axial mode according to one embodiment.

FIG. 9A is a graph 900*a* illustrating a radiation pattern of a helical antenna operating in an axial-mode according to one embodiment. When a circumference of a helical antenna is on the order of a wavelength, it can operate in the axial mode. In this mode of operation, there is one major lobe and the maximum radiation intensity is along an axis of the helix. The wavelength corresponds to an operating frequency of the helical antenna operating in the axial-mode.

Figure 9B:
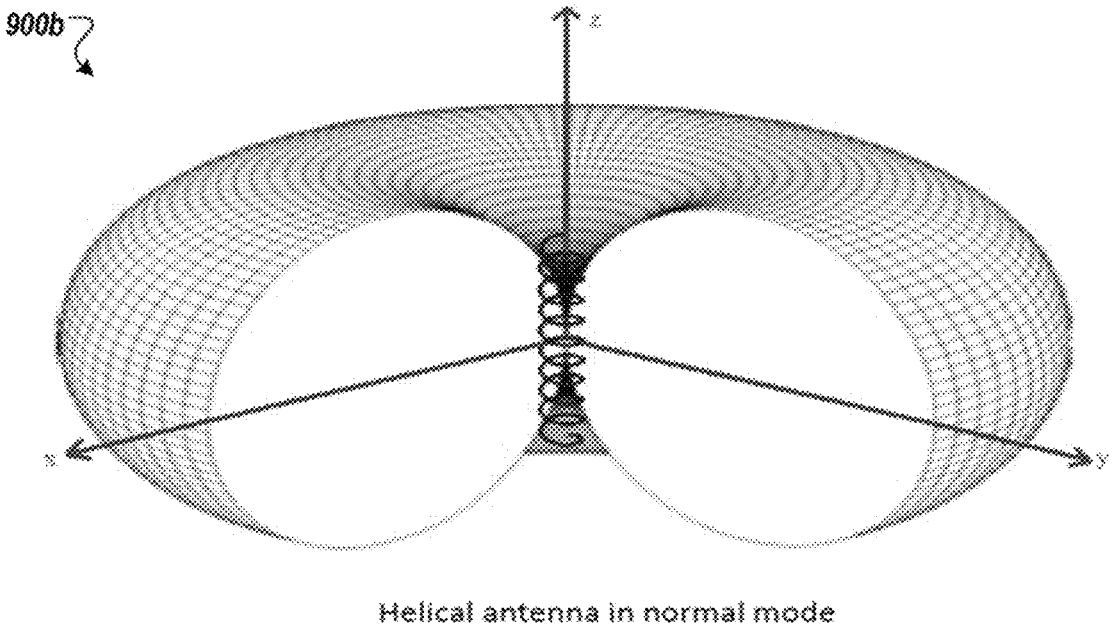
FIG. 9B is a graph illustrating a radiation pattern of a helical antenna operating in a normal mode according to one embodiment.

FIG. 9B is a graph 900*b* illustrating a radiation pattern of a helical antenna operating in a normal mode according to one embodiment. When a circumference of the helical antenna is much less than the wavelength, it can operate in the normal mode. In this mode of operation, the maximum radiation intensity is in a plane normal to the axis of the helix and a minimal radiation intensity is along the axis of the helix. The calibration antenna with the hybrid helical and patch design, such as the calibration antenna 104 of FIGS. 1-2 operates in a mode that is similar to the normal mode of the helical antenna.

Figure 10A:
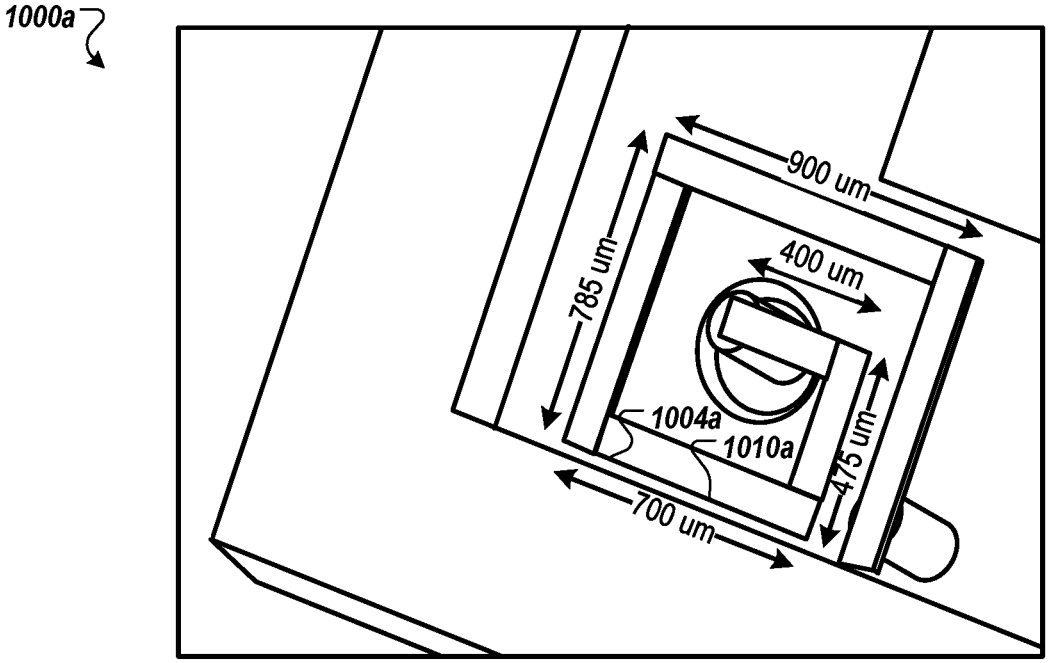
FIG. 10A illustrates an antenna structure with a calibration antenna according to one embodiment.

FIG. 10A illustrates an antenna structure 1000*a* with a calibration antenna 1004*a* according to one embodiment. Although not all components of the antenna structure 1000*a* are shown, the antenna structure 1000*a* is the same or similar to the antenna structure 100 of FIG. 1 as noted by similar reference numbers. A calibration antenna such as the calibration antenna 104 that has a winding or a spiral pattern is chiral and can have two forms, typically denoted by left and right (or left-handed (LH) and right-handed (RH)). In the depicted embodiment, the LH calibration antenna 1004*a* has a counterclockwise spiral pattern going inward (as viewed from the top (e.g., in a direction from the first plane to the ground plane), while the RH calibration antenna 1004*b* has a clockwise pattern going inward (as viewed from the top). In other words, the conductive trace of the LH calibration antenna 1004*a* is disposed in a counterclockwise spiral pattern from the ground pin (such as ground pin 114) to the first conductor (such as conductor 218), and the conductive trace of the RH calibration antenna 1004*b* is disposed in a clockwise spiral pattern from the ground pin to the first conductor. In the depicted embodiment, the calibration antenna 1004*a* can be denoted as LH and the calibration antenna 1004*b* described in FIG. 10B can be denoted as RH. However, it should be noted that LH and RH are conventional definitions and can be reversed. The LH calibration antenna 1004*a* is a mirror image of the RH calibration antenna 1004*b*. The LH calibration antenna 1004*a* is the same as the calibration antenna 104 of FIGS. 1-2. A direction of winding of the conductive trace of the calibration antenna element 1010*a* is the same as a direction of winding of the conductive trace of the calibration antenna element 110.

Figure 10B:
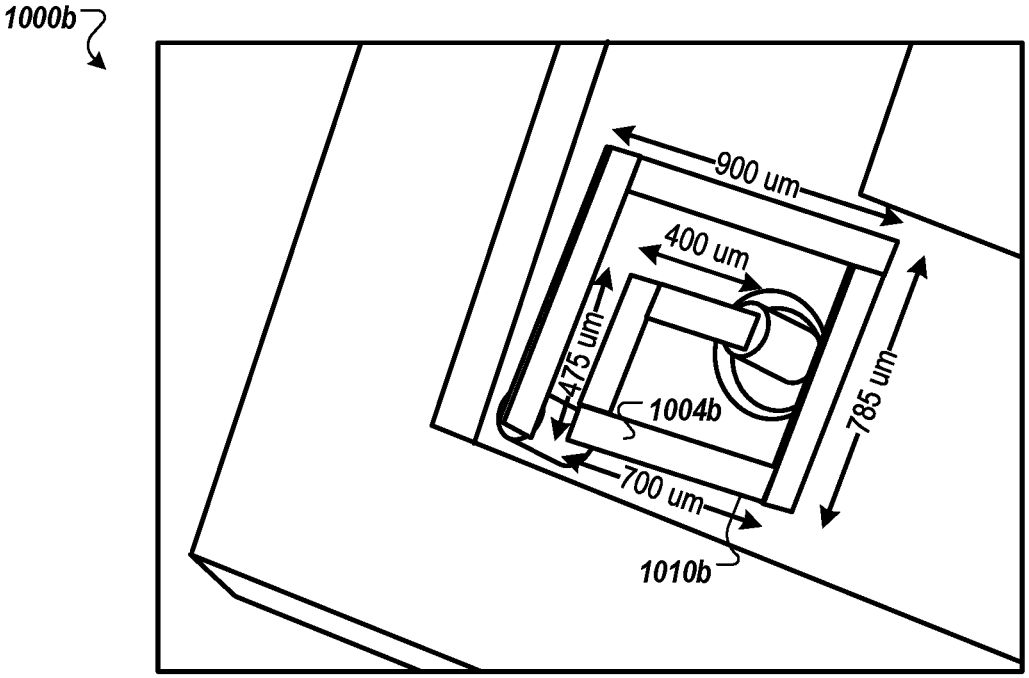
FIG. 10B illustrates an antenna structure with a calibration antenna according to one embodiment.

FIG. 10B illustrates an antenna structure 1000*b* with a calibration antenna 1004*b* according to one embodiment. Although not all components of the antenna structure 1000*b* are shown, the antenna structure 1000*b* is or similar to the antenna structure 100 of FIG. 1 except where noted below. The RH calibration antenna 1004*b* is similar to the calibration antenna 104 of FIGS. 1-2 except that a direction of winding of the conductive trace of the calibration antenna element 1010*b* is opposite to a direction of winding of the conductive trace of the calibration antenna element 110.

Figure 11A:
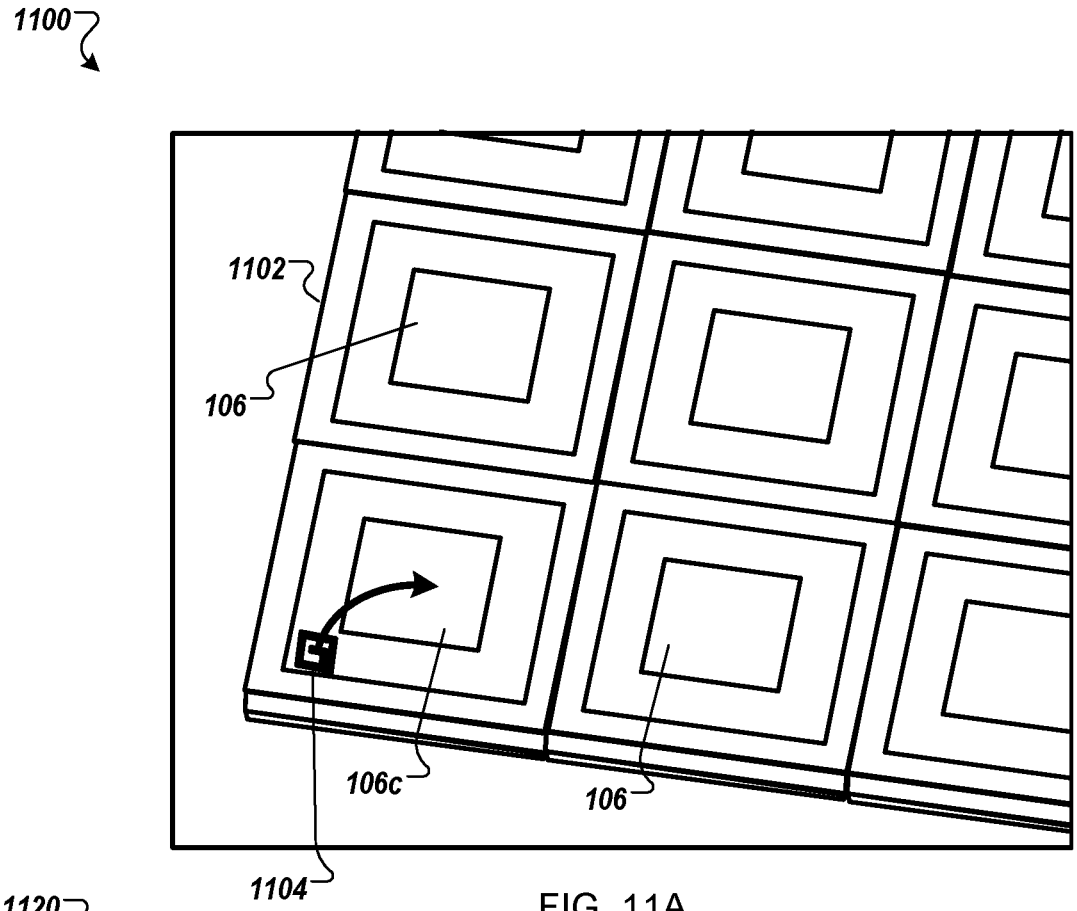
FIG. 11A illustrates an antenna structure with a calibration antenna of a phased array antenna operating in calibration mode according to one embodiment.

FIG. 11A illustrates an antenna structure 1100 with a calibration antenna 1104 of a phased array antenna 1102 operating in calibration mode according to one embodiment. Although not all components of the antenna structure 1100 are shown, the antenna structure 1100 is the same or similar to the antenna structure 100 of FIG. 1 except where noted below. The calibration antenna 1104 can be either the calibration antenna 1004*a* of FIG. 10A or the calibration 1004*b* of FIG. 10B. The calibration antenna performs calibration with an antenna element 106*c*.

As detailed in FIG. 1, the antenna elements 106, including the antenna element 106*a* and the antenna element 106*b* are coupled to the first RFFE circuitry, and the calibration antenna 1004 is coupled to the second RFFE circuitry. The first RFFE is coupled to the first RF module circuit and the second RFFE is coupled to the second RF module circuit. The first RF module circuit can include at least one RF component that has at least one of a phase parameter value, a gain parameter value, or a time-delay parameter value that are adjustable for calibrating at least one of a phase, a gain, or a time delay of a signal path between the first RF module circuit and at least one the antenna elements 106. Reference data can be obtained and stored in a memory device initially before the phased array antenna 1100 is launched and deployed in orbit. The calibration antenna 1104 can serve as an antenna within the phased array antenna 1100 to gather data from antenna elements of the phased array antenna, for example, via the second signal. The data can be compared to the reference data, and at least one of the phase parameter value, the gain parameter value, or the time-delay parameter value of the at least RF component can be adjusted based on the comparison.

In one embodiment, the phased array antenna 1100 can perform a first calibration. The first RF module circuit sends a first signal (e.g., such as an RF signal or other electromagnetic signal) via at least one of the antenna elements 106 including the antenna element 106*a* and/or the antenna element 106*b*. The second RF module circuit receives a second signal via the calibration antenna element 1110 of the calibration antenna 1104. The second signal is responsive to the first signal. Data associated with the second signal can be compared by a processor coupled to the memory device to the reference data stored on the memory device. At least one of the phase parameter value, the gain parameter value, or the time-delay parameter value of the at least RF component can be adjusted based on the comparison.

In another embodiment, the phased array antenna 1100 can perform a second calibration. The second RF module circuit sends a third signal via the calibration antenna element 1110. The first RF module circuit receives a fourth signal via at least one of the antenna elements 106 including the antenna element 106*a* and/or the antenna element 106*b*. The fourth signal is responsive to the third signal. Data associated with the fourth signal can be compared by the processor to the reference data stored on the memory device. At least one of the phase parameter value, the gain parameter value, or the time-delay parameter value of the at least RF component can be adjusted based on the comparison.

Figure 11B:
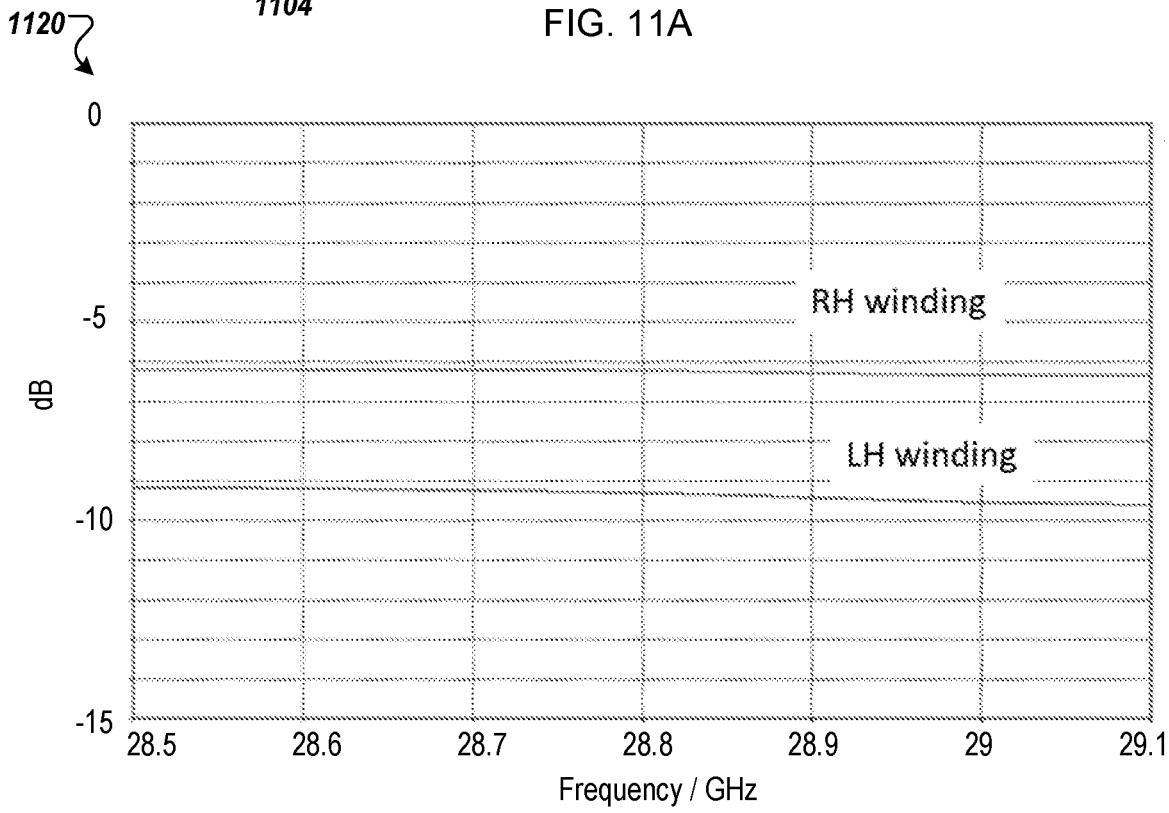
FIG. 11B is a graph of an insertion loss of the LH calibration antenna and the RH calibration antenna for a calibration of an antenna element 106*c* according to one embodiment.

FIG. 11B is a graph 1120 of an insertion loss of the LH calibration antenna 1104*a* and the RH calibration antenna 1104*b* for a calibration of an antenna element 106*c* according to one embodiment. The graph 1120 indicates that the insertion loss for the LH calibration antenna 1104*a* is approximately 3 dB lower than the insertion loss for the RH calibration antenna 1104*b* over a frequency band of interest for the antenna element 106*c*, and therefore the LH calibration antenna 1104*a* exhibits better antenna performance than the RH calibration antenna 1104*b*.

Figure 12A:
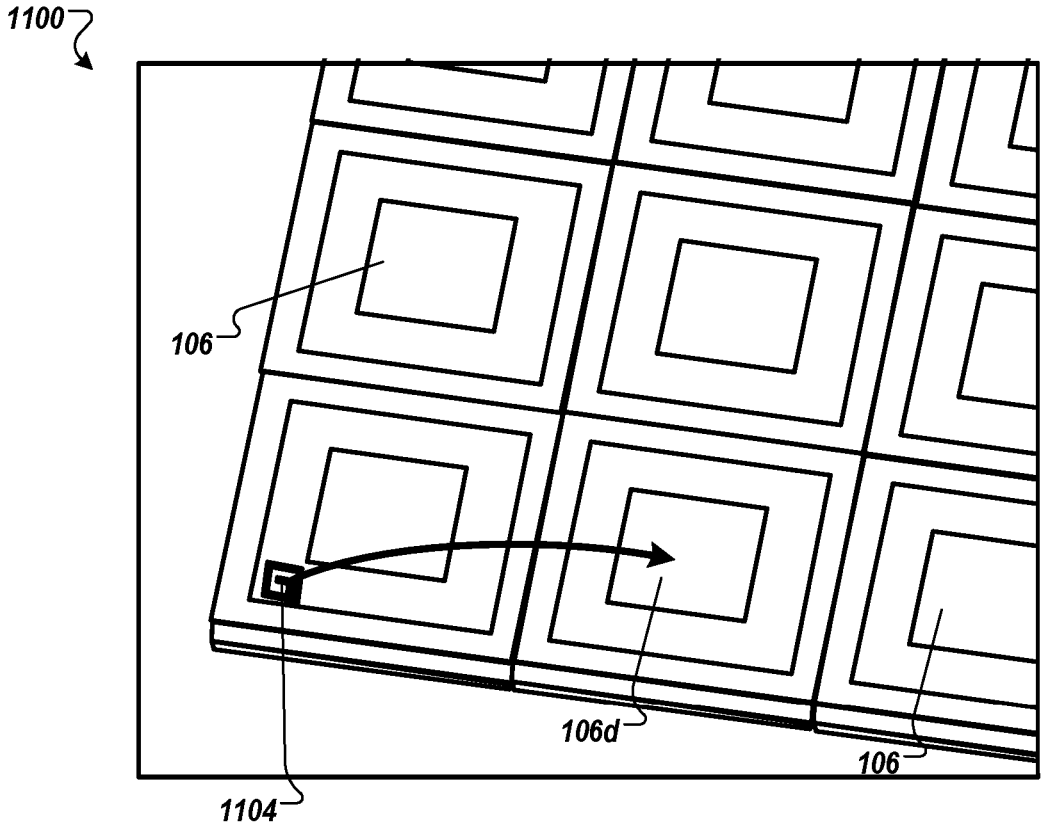
FIG. 12A illustrates an antenna structure 1100 with a calibration antenna of a phased array antenna operating in calibration mode according to one embodiment.

FIG. 12A illustrates an antenna structure 1100 with a calibration antenna 1104 of a phased array antenna 1102 operating in calibration mode according to one embodiment. Although not all components of the antenna structure 1100 are shown, the antenna structure 1100 is the same or similar to the antenna structure 100 of FIG. 1 except where noted below. The calibration antenna 1104 can be either the calibration antenna 1004*a* of FIG. 10A or the calibration 1004*b* of FIG. 10B. The calibration antenna performs calibration with an antenna element 106*d* as described with respect to FIG. 11A.

Figure 12B:
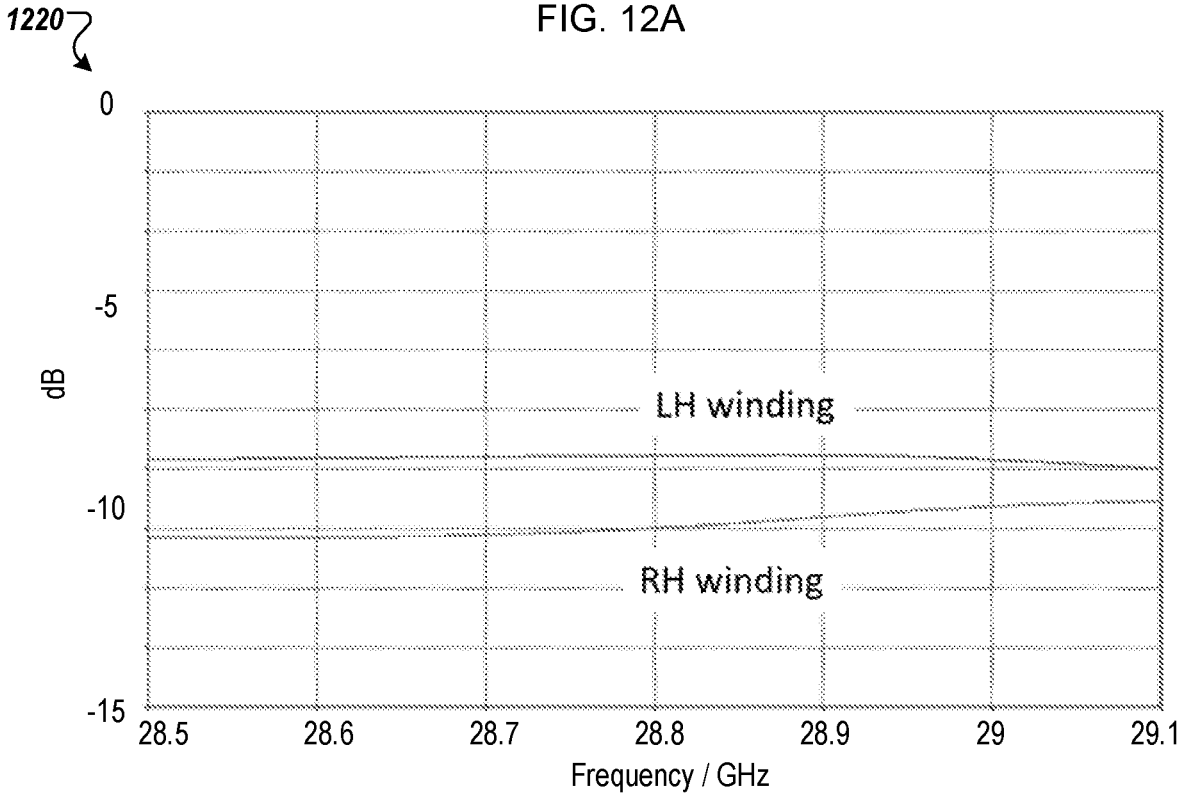
FIG. 12B is a graph of an insertion loss of the LH calibration antenna and the RH calibration antenna for a calibration of an antenna element according to one embodiment.

FIG. 12B is a graph 1220 of an insertion loss of the LH calibration antenna 1104*a* and the RH calibration antenna 1104*b* for a calibration of an antenna element 106*d* according to one embodiment. The graph 1220 indicates that the insertion loss for the LH calibration antenna 1104*a* is approximately between 7 dB and 3 dB higher than the insertion loss for the RH calibration antenna 1104*b* over a frequency band of interest for the antenna element 106*d*.

Figure 13A:
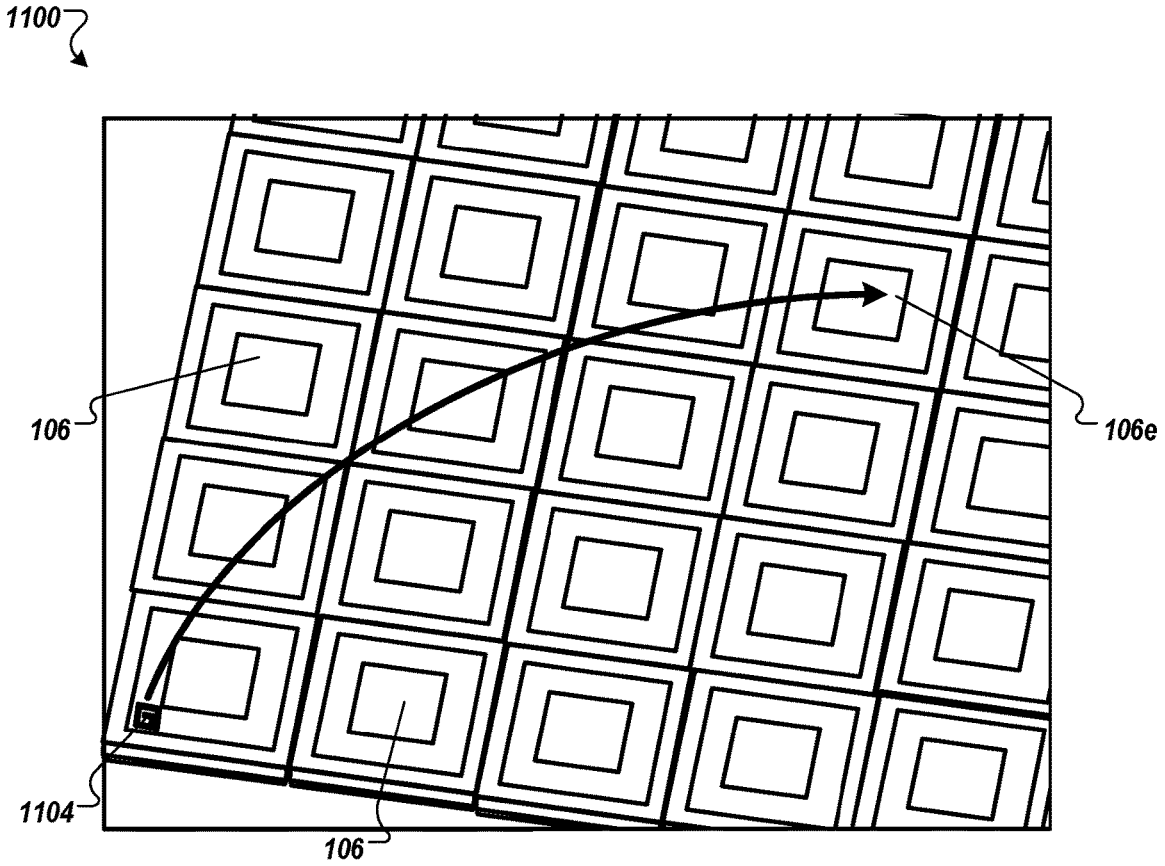
FIG. 13A illustrates an antenna structure with a calibration antenna of a phased array antenna operating in calibration mode according to one embodiment.

FIG. 13A illustrates an antenna structure 1100 with a calibration antenna 1104 of a phased array antenna 1102 operating in calibration mode according to one embodiment. Although not all components of the antenna structure 1100 are shown, the antenna structure 1100 is the same or similar to the antenna structure 100 of FIG. 1 except where noted below. The calibration antenna 1104 can be either the calibration antenna 1004*a* of FIG. 10A or the calibration 1004*b* of FIG. 10B. The calibration antenna performs calibration with an antenna element 106*e* as described with respect to FIG. 11A.

Figure 13B:
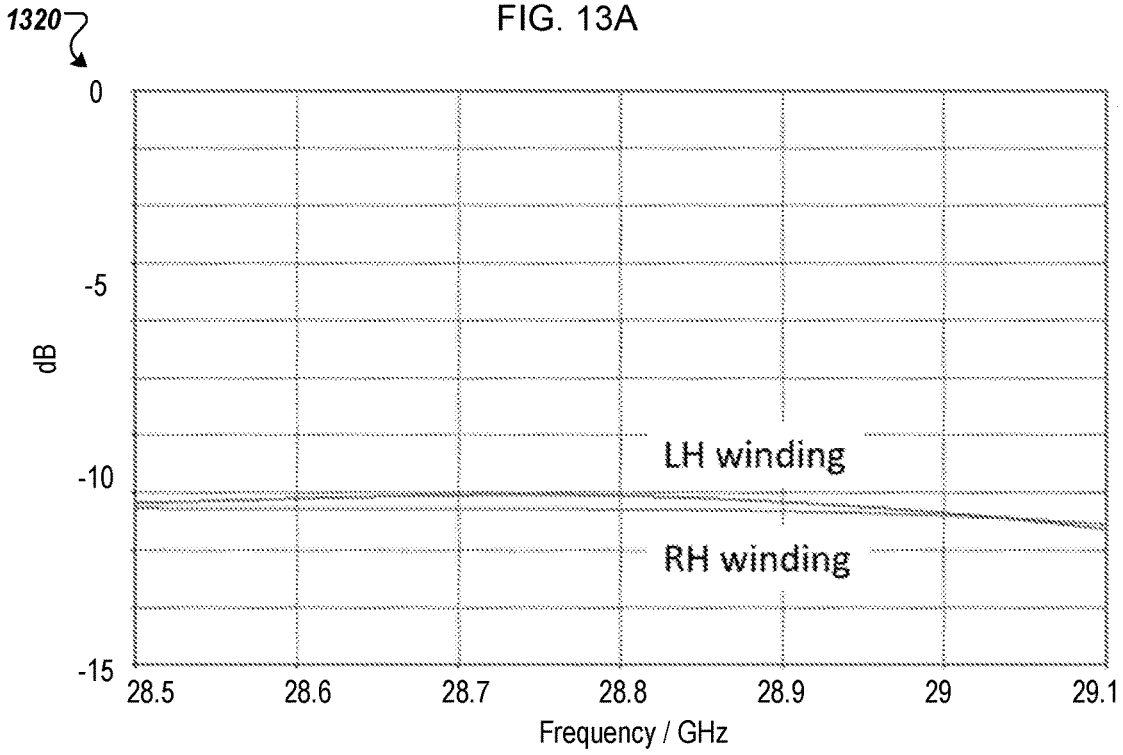
FIG. 13B is a graph of an insertion loss of the LH calibration antenna and the RH calibration antenna for a calibration of an antenna element according to one embodiment.

FIG. 13B is a graph 1320 of an insertion loss of the LH calibration antenna 1104*a* and the RH calibration antenna 1104*b* for a calibration of an antenna element 106*e* according to one embodiment. The graph 1320 indicates that the insertion loss for the LH calibration antenna 1104*a* is similar to the insertion loss for the RH calibration antenna 1104*b* over a frequency band of interest for the antenna element 106*e*.

Figure 14A:
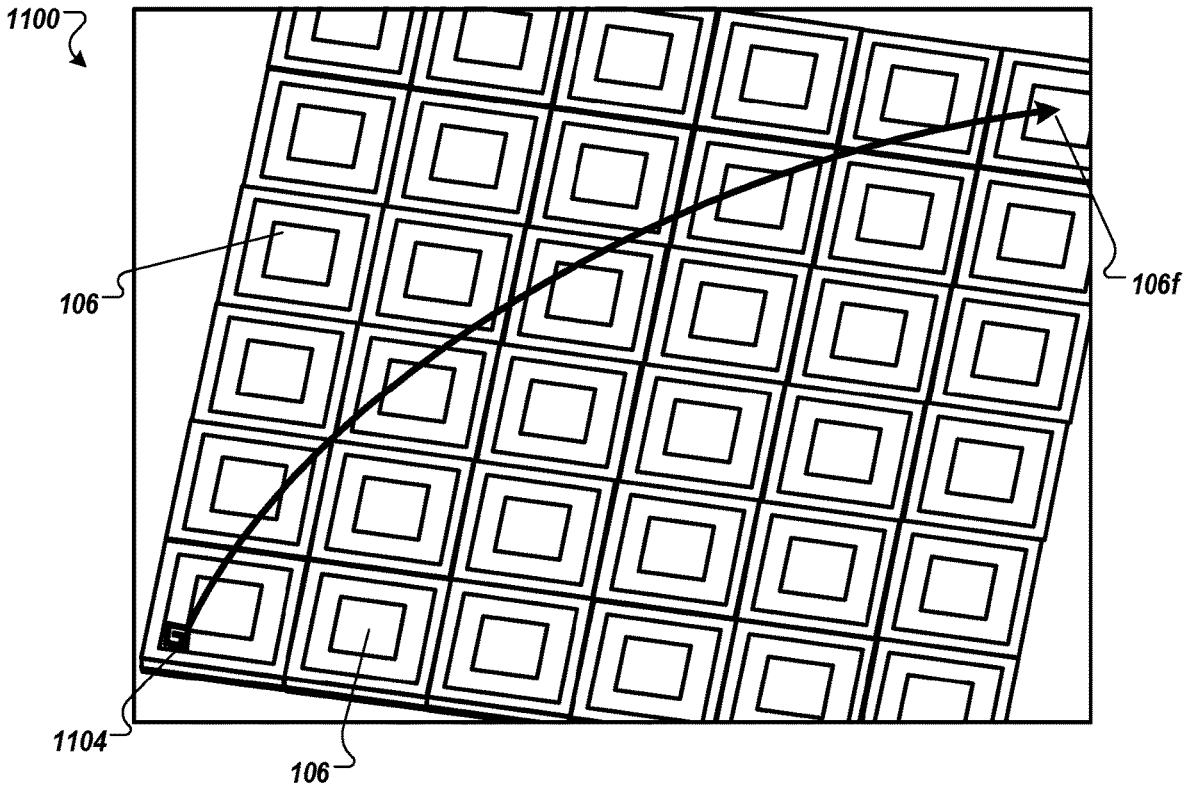
FIG. 14A illustrates an antenna structure with a calibration antenna of a phased array antenna operating in calibration mode according to one embodiment.

FIG. 14A illustrates an antenna structure 1100 with a calibration antenna 1104 of a phased array antenna 1102 operating in calibration mode according to one embodiment. Although not all components of the antenna structure 1100 are shown, the antenna structure 1100 is the same or similar to the antenna structure 100 of FIG. 1 except where noted below. The calibration antenna 1104 can be either the calibration antenna 1004*a* of FIG. 10A or the calibration 1004*b* of FIG. 10B. The calibration antenna performs calibration with an antenna element 106*e* as described with respect to FIG. 11A.

Figure 14B:
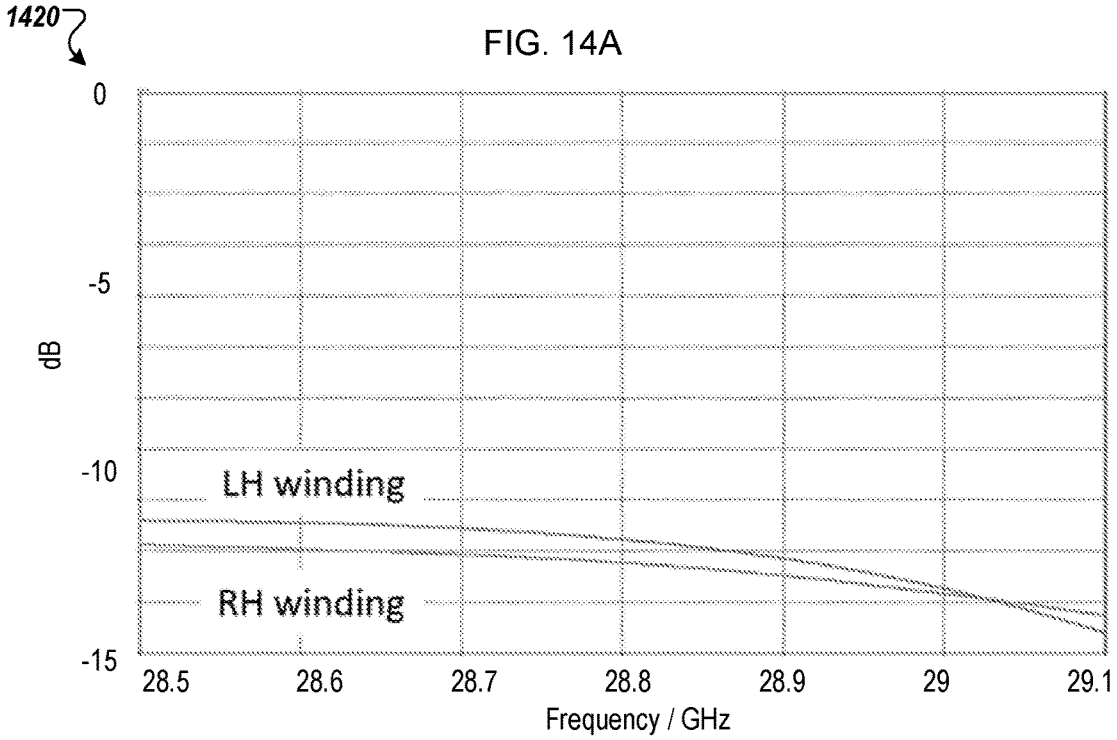
FIG. 14B is a graph of an insertion loss of the LH calibration antenna and the RH calibration antenna for a calibration of an antenna element according to one embodiment.

FIG. 14B is a graph 1420 of an insertion loss of the LH calibration antenna 1104*a* and the RH calibration antenna 1104*b* for a calibration of an antenna element 106*f* according to one embodiment. The graph 1420 indicates that the insertion loss for the LH calibration antenna 1104*a* is similar to the insertion loss for the RH calibration antenna 1104*b* over a frequency band of interest for the antenna element 106*f*.

Figure 15:
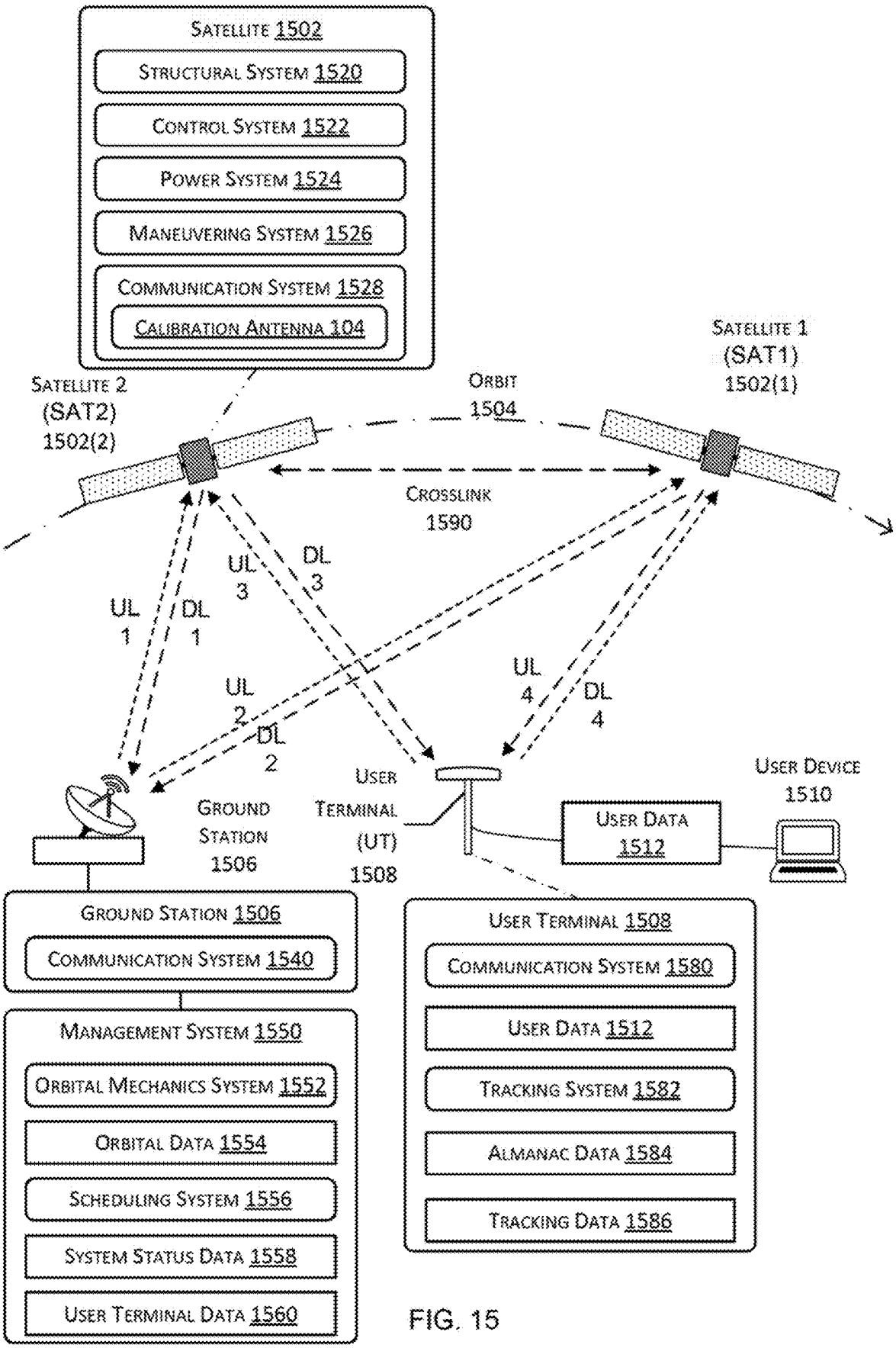
FIG. 15 illustrates a system including a constellation of satellites each satellite being in orbit according to one embodiment.

FIG. 15 illustrates a system 1500 including a constellation of satellites 1502(1), 1502(2), . . . , 1502(S), each satellite 1502 being in orbit 1504 according to one embodiment. The system 1500 shown here comprises a plurality (or "constellation") of satellites 1502(1), 1502(2), . . . , 1502(S), each satellite 1502 being in orbit 1504. Any of the satellites 1502 can include the antenna structure 100 of FIG. 1, the antenna structure 200 of FIG. 2, the antenna structure 300 of FIG. 3, the antenna structure 400*a* of FIG. 4A, the antenna structure 400*b* of FIG. 4B, the antenna structure 500 of FIG. 5, the antenna structure 1000*a* of FIG. 10A, the antenna structure 1000 of FIG. 10B, or the antenna structure 1100 of FIG. 11. Also shown is a ground station 1506, user terminal (UT) 1508, and a user device 1510.

The constellation may comprise hundreds or thousands of satellites 1502, in various orbits 1504. For example, one or more of these satellites 1502 may be in non-geosynchronous orbits (NGOs) in which they are in constant motion with respect to the Earth. For example, the orbit 1504 is a low earth orbit (LEO). In this illustration, orbit 1504 is depicted with an arc pointed to the right. A first satellite (SAT1) 1502(1) is leading (ahead of) a second satellite (SAT2) 1502(2) in the orbit 1504.

The satellite 1502 may comprise a structural system 1520, a control system 1522, a power system 1524, a maneuvering system 1526, and a communication system 1528 including a phased array antenna with an embedded calibration antenna, such as the calibration antenna 104 described herein. In other implementations, some systems may be omitted or other systems added. One or more of these systems may be communicatively coupled with one another in various combinations.

The structural system 1520 comprises one or more structural elements to support operation of the satellite 1502. For example, the structural system 1520 may include trusses, struts, panels, and so forth. The components of other systems may be affixed to, or housed by, the structural system 1520. For example, the structural system 1520 may provide mechanical mounting and support for solar panels in the power system 1524. The structural system 1520 may also provide for thermal control to maintain components of the satellite 1502 within operational temperature ranges. For example, the structural system 1520 may include louvers, heat sinks, radiators, and so forth.

The control system 1522 provides various services, such as operating the onboard systems, resource management, providing telemetry, processing commands, and so forth. For example, the control system 1522 may direct operation of the communication system 1528.

The power system 1524 provides electrical power for operation of the components onboard the satellite 1502. The power system 1524 may include components to generate electrical energy. For example, the power system 1524 may comprise one or more photovoltaic cells, thermoelectric devices, fuel cells, and so forth. The power system 1524 may include components to store electrical energy. For example, the power system 1524 may comprise one or more batteries, fuel cells, and so forth.

The maneuvering system 1526 maintains the satellite 1502 in one or more of a specified orientation or orbit 1504. For example, the maneuvering system 1526 may stabilize the satellite 1502 with respect to one or more axis. In another example, the maneuvering system 1526 may move the satellite 1502 to a specified orbit 1504. The maneuvering system 1526 may include one or more computing devices, sensors, thrusters, momentum wheels, solar sails, drag devices, and so forth. For example, the sensors of the maneuvering system 1526 may include one or more global navigation satellite system (GNSS) receivers, such as global positioning system (GPS) receivers, to provide information about the position and orientation of the satellite 1502 relative to Earth. In another example, the sensors of the maneuvering system 1526 may include one or more star trackers, horizon detectors, and so forth. The thrusters may include, but are not limited to, cold gas thrusters, hypergolic thrusters, solid-fuel thrusters, ion thrusters, arcjet thrusters, electrothermal thrusters, and so forth.

The communication system 1528 provides communication with one or more other devices, such as other satellites 1502, ground stations 1506, user terminals 1508, and so forth. The communication system 1528 may include one or more modems, digital signal processors, power amplifiers, antennas (including at least one antenna that implements multiple antenna elements, such as a phased array antenna, and including an embedded calibration antenna, such as the calibration antenna 104 as described herein), processors, memories, storage devices, communications peripherals, interface buses, and so forth. Such components support communications with other satellites 1502, ground stations 1506, user terminals 1508, and so forth using radio frequencies within a desired frequency spectrum. The communications may involve multiplexing, encoding, and compressing data to be transmitted, modulating the data to a desired radio frequency, and amplifying it for transmission. The communications may also involve demodulating received signals and performing any necessary de-multiplexing, decoding, decompressing, error correction, and formatting of the signals. Data decoded by the communication system 1528 may be output to other systems, such as to the control system 1522, for further processing. Output from a system, such as the control system 1522, may be provided to the communication system 1528 for transmission.

One or more ground stations 1506 are in communication with one or more satellites 1502. The ground stations 1506 may pass data between the satellites 1502, a management system 1550, networks such as the Internet, and so forth. The ground stations 1506 may be emplaced on land, on vehicles, at sea, and so forth. Each ground station 1506 may comprise a communication system 1540. Each ground station 1506 may use the communication system 1540 to establish communication with one or more satellites 1502, other ground stations 1506, and so forth. The ground station 1506 may also be connected to one or more communication networks. For example, the ground station 1506 may connect to a terrestrial fiber optic communication network. The ground station 1506 may act as a network gateway, passing user data 1512 or other data between the one or more communication networks and the satellites 1502. Such data may be processed by the ground station 1506 and communicated via the communication system 1540. The communication system 1540 of a ground station may include components similar to those of the communication system 1528 of a satellite 1502 and may perform similar communication functionalities. For example, the communication system 1540 may include one or more modems, digital signal processors, power amplifiers, antennas (including at least one antenna that implements multiple antenna elements, such as a phased array antenna), processors, memories, storage devices, communications peripherals, interface buses, and so forth.

The ground stations 1506 are in communication with a management system 1550. The management system 1550 is also in communication, via the ground stations 1506, with the satellites 1502 and the UTs 1508. The management system 1550 coordinates operation of the satellites 1502, ground stations 1506, UTs 1508, and other resources of the system 1500. The management system 1550 may comprise one or more of an orbital mechanics system 1552 or a scheduling system 1556.

The orbital mechanics system 1552 determines orbital data 1554 that is indicative of a state of a particular satellite 1502 at a specified time. In one implementation, the orbital mechanics system 1552 may use orbital elements that represent characteristics of the orbit 1504 of the satellites 1502 in the constellation to determine the orbital data 1554 that predicts location, velocity, and so forth of particular satellites 1502 at particular times or time intervals. For example, the orbital mechanics system 1552 may use data obtained from actual observations from tracking stations, data from the satellites 1502, scheduled maneuvers, and so forth to determine the orbital elements. The orbital mechanics system 1552 may also consider other data, such as space weather, collision mitigation, orbital elements of known debris, and so forth.

The scheduling system 1556 schedules resources to provide communication to the UTs 1508. For example, the scheduling system 1556 may determine handover data that indicates when communication is to be transferred from the first satellite 1502(1) to the second satellite 1502(2). Continuing the example, the scheduling system 1556 may also specify communication parameters such as frequency, timeslot, and so forth. During operation, the scheduling system 1556 may use information such as the orbital data 1554, system status data 1558, user terminal data 1560, and so forth.

The system status data 1558 may comprise information such as which UTs 1508 are currently transferring data, satellite availability, current satellites 1502 in use by respective UTs 1508, capacity available at particular ground stations 1506, and so forth. For example, the satellite availability may comprise information indicative of satellites 1502 that are available to provide communication service or those satellites 1502 that are unavailable for communication service. Continuing the example, a satellite 1502 may be unavailable due to malfunction, previous tasking, maneuvering, and so forth. The system status data 1558 may be indicative of past status, predictions of future status, and so forth. For example, the system status data 1558 may include information such as projected data traffic for a specified interval of time based on previous transfers of user data 1512. In another example, the system status data 1558 may be indicative of future status, such as a satellite 1502 being unavailable to provide communication service due to scheduled maneuvering, scheduled maintenance, scheduled decommissioning, and so forth.

The user terminal data 1560 may comprise information such a location of a particular UT 1508. The user terminal data 1560 may also include other information such as a priority assigned to user data 1512 associated with that UT 1508, information about the communication capabilities of that particular UT 1508, and so forth. For example, a particular UT 1508 in use by a business may be assigned a higher priority relative to a UT 1508 operated in a residential setting. Over time, different versions of UTs 1508 may be deployed, having different communication capabilities such as being able to operate at particular frequencies, supporting different signal encoding schemes, having different antenna configurations, and so forth.

The UT 1508 includes a communication system 1580 to establish communication with one or more satellites 1502. The communication system 1580 of the UT 1508 may include components similar to those of the communication system 1528 of a satellite 1502 and may perform similar communication functionalities. For example, the communication system 1580 may include one or more modems, digital signal processors, power amplifiers, antennas (including at least one antenna that implements multiple antenna elements, such as a phased array antenna), processors, memories, storage devices, communications peripherals, interface buses, and so forth. The UT 1508 passes user data 1512 between the constellation of satellites 1502 and the user device 1510. The user data 1512 includes data originated by the user device 1510 or addressed to the user device 1510. The UT 1508 may be fixed or in motion. For example, the UT 1508 may be used at a residence, or on a vehicle such as a car, boat, aerostat, drone, airplane, and so forth.

The UT 1508 includes a tracking system 1582. The tracking system 1582 uses almanac data 1584 to determine tracking data 1586. The almanac data 1584 provides information indicative of orbital elements of the orbit 1504 of one or more satellites 1502. For example, the almanac data 1584 may comprise orbital elements such as "two-line element" data for the satellites 1502 in the constellation that are broadcast or otherwise sent to the UTs 1508 using the communication system 1580.

The tracking system 1582 may use the current location of the UT 1508 and the almanac data 1584 to determine the tracking data 1586 for the satellite 1502. For example, based on the current location of the UT 1508 and the predicted position and movement of the satellites 1502, the tracking system 1582 is able to calculate the tracking data 1586. The tracking data 1586 may include information indicative of azimuth, elevation, distance to the second satellite, time of flight correction, or other information at a specified time. The determination of the tracking data 1586 may be ongoing. For example, the first UT 1508 may determine tracking data 1586 every 1500 ms, every second, every five seconds, or at other intervals.

With regard to FIG. 15, an uplink is a communication link which allows data to be sent to a satellite 1502 from a ground station 1506, UT 1508, or device other than another satellite 1502. Uplinks are designated as UL1, UL2, UL3 and so forth. For example, UL1 is a first uplink from the ground station 1506 to the second satellite 1502(2). In comparison, a downlink is a communication link which allows data to be sent from the satellite 1502 to a ground station 1506, UT 1508, or device other than another satellite 1502. For example, DL1 is a first downlink from the second satellite 1502(2) to the ground station 1506. The satellites 1502 may also be in communication with one another. For example, a crosslink 1590 provides for communication between satellites 1502 in the constellation.

The satellite 1502, the ground station 1506, the user terminal 1508, the user device 1510, the management system 1550, or other systems described herein may include one or more computer devices or computer systems comprising one or more hardware processors, computer-readable storage media, and so forth. For example, the hardware processors may include application specific integrated circuits (ASICs), field-programmable gate arrays (FPGAs), microcontrollers, digital signal processors (DSPs), and so forth. The computer-readable storage media can include system memory, which may correspond to any combination of volatile and/or non-volatile memory or storage technologies. The system memory can store information that provides an operating system, various program modules, program data, and/or other software or firmware components. In one embodiment, the system memory stores instructions of methods to control operation of the electronic device. The electronic device performs functions by using the processor (s) to execute instructions provided by the system memory. Embodiments may be provided as a software program or computer program including a non-transitory computer-readable storage medium having stored thereon instructions (in compressed or uncompressed form) that may be used to program a computer (or other electronic device) to perform the processes or methods described herein. The computer-readable storage medium may be one or more of an electronic storage medium, a magnetic storage medium, an optical storage medium, a quantum storage medium, and so forth. For example, the computer-readable storage medium may include, but is not limited to, hard drives, floppy diskettes, optical disks, read-only memories (ROMs), random access memories (RAMs), erasable programmable ROMs (EPROMs), electrically erasable programmable ROMs (EEPROMs), flash memory, magnetic or optical cards, solid-state memory devices, or other types of physical media suitable for storing electronic instructions. Further embodiments may also be provided as a computer program product including a transitory machine-readable signal (in compressed or uncompressed form). Examples of transitory machine-readable signals, whether modulated using a carrier or unmodulated, include, but are not limited to, signals that a computer system or machine hosting or running a computer program can be configured to access, including signals transferred by one or more networks. For example, the transitory machine-readable signal may comprise transmission of software by the Internet.

Figure 16:
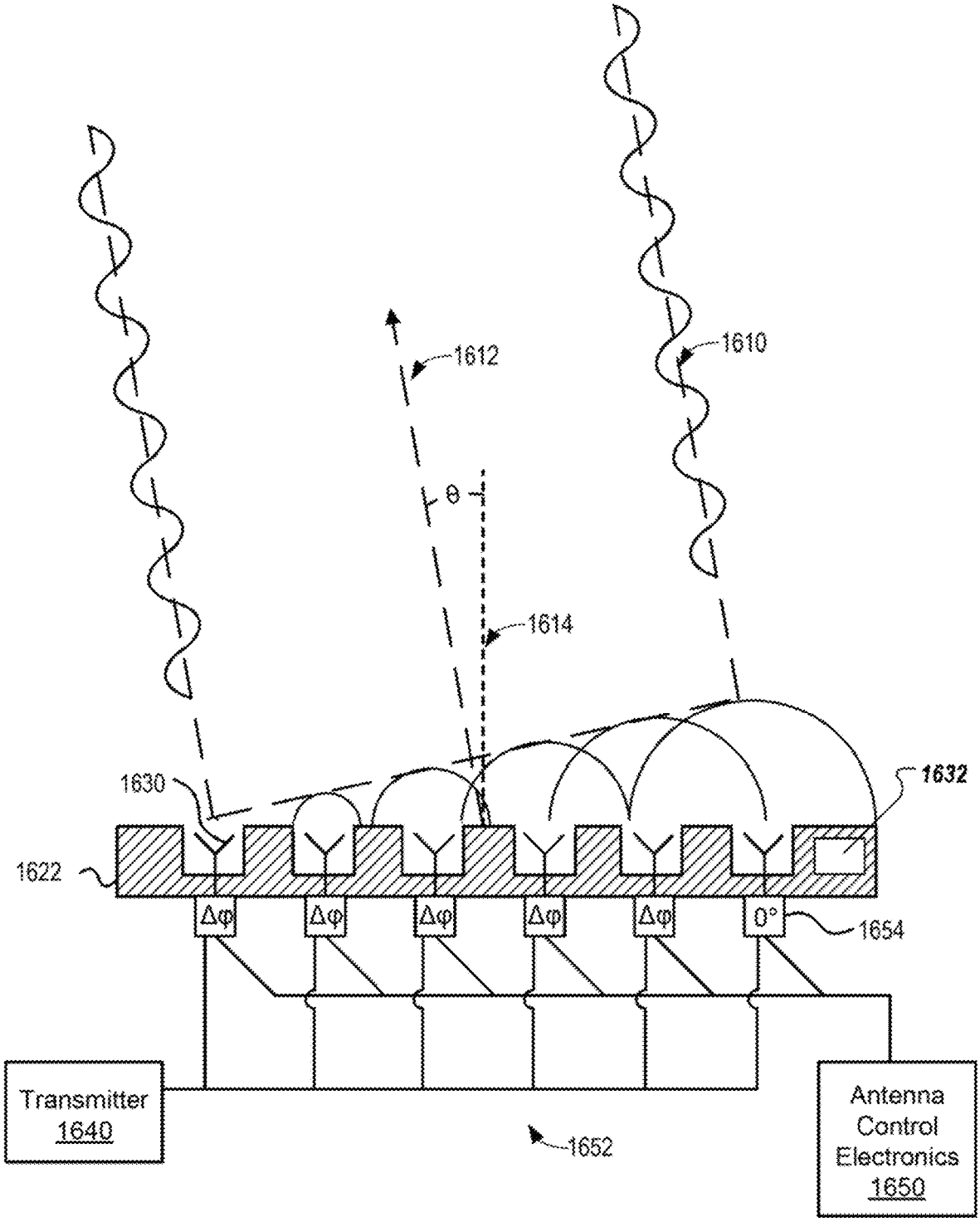
FIG. 16 illustrates a simplified schematic of an antenna, according to embodiments of the present disclosure.

FIG. 16 illustrates a simplified schematic of an antenna 1600, according to embodiments of the present disclosure. As illustrated, the antenna 1600 is a phased array antenna that includes multiple antenna elements 1630 and an embedded calibration antenna 1632. The embedded calibration antenna 1632 can be any of the calibration antennas 104/1004*a*/1004*b*/1104 described above. Interference between the antenna elements 1630 forms a directional radiation pattern in both transmitter and receiver arrays forming a beam 1610 (beam extents shown as dashed lines). The beam 1610 is a portion of a larger transmission pattern (not shown) that extends beyond the immediate vicinity of the antenna 1600. The beam 1610 is directed along a beam vector 1612, described by an angle "θ" relative to an axis 1614 normal to a surface of the antenna 1600. As described below, the beam 1610 is one or more of steerable or shapeable through control of operating parameters including, but not limited to a phase and an amplitude of each antenna element.

In FIG. 16, the antenna 1600 includes, within a transmitter section 1622, the plurality of antenna elements 1630, which may include, but are not limited to, omnidirectional transmitter antennas coupled to a transmitter system 1640. The transmitter system 1640 provides a signal, such as a downlink signal to be transmitted to a ground station on the surface. The downlink signal is provided to each antenna element 1630 as a time-varying signal that may include several multiplexed signals. To steer the beam 1610 relative to the axis 1614, the phased array antenna system 1600 includes antenna control electronics 1650 controlling a radio frequency (RF) feeding network 1652, including a plurality of signal conditioning components 1654 interposed between the antenna elements 1630 and the transmitter system 1640. The signal conditioning components 1654 introduce one or more of a phase modulation or an amplitude modulation, as denoted by "Ay" in FIG. 16, to the signal sent to the antenna elements 1630. As shown in FIG. 16, introducing a progressive phase modulation produces interference in the individual transmission of each antenna element 1630 that generates the beam 1610.

The phase modulation imposed on each antenna element will differ and will be dependent on a spatial location of a communication target that determines an optimum beam vector (e.g., where the beam vector 1612 is found by one or more of maximizing signal intensity or connection strength). The optimum beam vector may change with time as the communication target moves relative to the phased array antenna system 1600.

Although antenna 1600 is illustrated with a transmitter section 1622, in other embodiments, the antenna 1600 can be a receiver section that includes the plurality of antenna elements 1630 coupled to a receiver system (not illustrated). The embedded calibration antenna 1632 can be embedded within the dielectric material as described herein.

In the above description, numerous details are set forth. It will be apparent, however, to one of ordinary skill in the art having the benefit of this disclosure, that embodiments may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to convey the substance of their work most effectively to others skilled in the art. An algorithm is used herein, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments also relate to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but not limited to, any type of disk including floppy disks, optical disks, Read-Only Memories (ROMs), compact disc ROMs (CD-ROMs) and magnetic-optical disks, Random Access Memories (RAMs), EPROMs, EEPROMs, magnetic or optical cards, or any type of media suitable for storing electronic instructions.

The algorithms and displays presented herein are not inherently related to any particular computer or other apparatus. Various general-purpose systems may be used with programs in accordance with the teachings herein, or it may prove convenient to construct a more specialized apparatus to perform the required method steps. The required structure for a variety of these systems will appear from the description below. In addition, the present embodiments are not described with reference to any particular programming language. It will be appreciated that a variety of programming languages may be used to implement the teachings of the present embodiments as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present embodiments should, therefore, be determined with reference to the appended claims, along with the full scope of equivalents to which such claims are entitled.

What is claimed is:

1. A communication system comprising:

a first radio frequency (RF) module circuit;

first radio frequency front-end (RFFE) circuitry coupled to the first RF module circuit; and a phased array antenna coupled to the first RFFE circuitry, the phased array antenna comprising:

a ground plane;

a dielectric material located on a first side of the ground plane;

a plurality of antenna elements located on the dielectric material in a first plane, wherein a first antenna element of the plurality of antenna elements and a second antenna element of the plurality of antenna elements are separated by at least a first distance;

a second RF module circuit;

second RFFE circuitry coupled to the second RF module circuit; and a calibration antenna coupled to the second RFFE circuitry, the calibration antenna being fully embedded within the dielectric material and located between the first antenna element and the second antenna element, the calibration antenna comprising:

an antenna element located on a second plane that is parallel to the first plane and the ground plane;

a conductor coupled between a first end of the antenna element and a feed point located in an opening of the ground plane; and a ground pin coupled between a second end of the antenna element and the ground plane.

2. The communication system of claim 1, wherein the phased array antenna further comprises:

a wall structure comprising conductive material located on the first plane, the wall structure defining a plurality of regions physically separated and electrically isolated from each other by a portion of the wall structure, wherein the first antenna element is located in a first region of the plurality of regions and the second antenna element is located in a second region of the plurality of regions, and wherein the calibration antenna is located between the first antenna element and a first portion of the wall structure that is adjacent to the first region.

3. An antenna structure comprising:

a ground plane;

a first antenna element located in a first plane;

a second antenna element located in the first plane and separated from the first antenna element by a first distance;

dielectric material located between the ground plane and the first plane; and a third antenna element located in a second plane that is located between the ground plane and the first plane, wherein the third antenna element is located in an area having a first dimension and a second dimension that are each less than half the first distance, wherein:

the antenna structure is a phased array antenna and is part of a satellite; and the third antenna element is configured to operate as a calibration antenna for in-orbit calibration of the phased array antenna.

4. The antenna structure of claim 3, further comprising a wall structure that forms a perimeter around the first antenna element, wherein the third antenna element is located between the first antenna element and at least one side of the wall structure.

5. The antenna structure of claim 3, wherein the third antenna element comprises:

a conductive trace;

a first conductor coupled between a first end of the conductive trace and a feed point located in an opening of the ground plane; and a second conductor coupled between a second end of the conductive trace and the ground plane, wherein the conductive trace surrounds a first point within the area.

6. The antenna structure of claim 5, wherein the third antenna element comprises a conductive trace disposed in a spiral pattern that winds in a clockwise direction from the second conductor to the first conductor.

7. The antenna structure of claim 5, wherein the third antenna element comprises a conductive trace disposed in a spiral pattern that winds in a counterclockwise direction from the second conductor to the first conductor.

8. The antenna structure of claim 3, wherein the first antenna element and the second antenna element are patch elements.

9. The antenna structure of claim 3, wherein the first antenna element and the second antenna element are slot antennas.

10. The antenna structure of claim 3, further comprising:

a fourth antenna element located in the first plane;

a fifth antenna element located in the first plane and separated from the fourth antenna element by the first distance; and a sixth antenna element located in the second plane, wherein the sixth antenna element is located in a second area having a first dimension and a second dimension that are each less than half the first distance.

11. The antenna structure of claim 3, further comprising:

a fourth antenna element located in the first plane and near an edge of the antenna structure; and a fifth antenna element located in the second plane and between the fourth antenna element and the edge of the antenna structure.

12. The antenna structure of claim 11, further comprising a first wall that is disposed between the fourth antenna element and the edge of the antenna structure, wherein the fifth antenna element is located between the fourth antenna element and the first wall.

13. A communication system comprising:

a first radio frequency (RF) module circuit;

first radio frequency front-end (RFFE) circuitry coupled to the first RF module circuit;

a ground plane;

a first antenna element of an antenna array, the first antenna element being located in a first plane;

a second antenna element of the antenna array, the second antenna element being located in the first plane and separated from the first antenna element by a first distance;

dielectric material located between the ground plane and the first plane; and a third antenna element coupled to the first RFFE circuitry and located in a second plane that is located between the ground plane and the first plane, wherein the third antenna element is located in an area of the dielectric material that is located between the first antenna element and the second antenna element, wherein the third antenna element comprises:

a conductive trace;

a first conductor coupled between a first end of the conductive trace and a feed point located in an opening of the ground plane; and a second conductor coupled between a second end of the conductive trace and the ground plane.

14. The communication system of claim 13, wherein the conductive trace is disposed in a spiral pattern that winds in one of a clockwise direction or a counterclockwise direction from the second conductor to the first conductor.

15. The communication system of claim 13, wherein the area comprises a first dimension and a second dimension that each is less than half the first distance.

16. The communication system of claim 13, further comprising a first wall that physical separates and electrically isolates a first region and a second region, wherein the first antenna element is located in the first region and the second antenna element is located in the second region, wherein the third antenna element is located in a portion of the area that is located between the first antenna element and the first wall.

17. The communication system of claim 13, further comprising:

a second RF module circuit; and second RFFE circuitry coupled to the second RF module circuit and the first antenna element and the second antenna element, wherein the second RF module circuit sends a first signal via the first antenna element and the second antenna element, and wherein the first RF module circuit receives a second signal via the third antenna element, the second signal being responsive to the first signal.

18. The communication system of claim 13, further comprising:

a second RF module circuit; and second RFFE circuitry coupled to the second RF module circuit and the first antenna element and the second antenna element, wherein the first RF module circuit sends a first signal via the third antenna element, and wherein the second RF module circuit receives a second signal via at least one of the first antenna element or the second antenna element, the second signal being responsive to the first signal.

19. The communication system of claim 13, wherein the communication system is part of a satellite.

* * * * *